US010256031B2

(12) United States Patent
Baker et al.

(10) Patent No.: US 10,256,031 B2
(45) Date of Patent: Apr. 9, 2019

(54) LOW-PROFILE COUPLED INDUCTORS WITH LEAKAGE CONTROL

(71) Applicant: Maxim Integrated Products, Inc., San Jose, CA (US)

(72) Inventors: Michael Warren Baker, Arlington, MA (US); Jizheng Qiu, Lowell, MA (US); Brett A. Miwa, Wellesley, MA (US); Alexandr Ikriannikov, Castro Valley, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 0 days.

(21) Appl. No.: 15/945,894

(22) Filed: Apr. 5, 2018

(65) Prior Publication Data

US 2018/0226186 A1 Aug. 9, 2018

Related U.S. Application Data

(62) Division of application No. 14/867,942, filed on Sep. 28, 2015.

(Continued)

(51) Int. Cl.
*H01F 27/24* (2006.01)
*H01F 17/04* (2006.01)

(Continued)

(52) U.S. Cl.
CPC ..... *H01F 27/2823* (2013.01); *H01F 27/306* (2013.01); *H01F 27/346* (2013.01)

(58) Field of Classification Search
CPC ..... H01F 27/24

(Continued)

(56) References Cited

U.S. PATENT DOCUMENTS 1,624,536 A * 4/1927 Christopher ..... H04M 1/02 310/216.017
2,212,543 A 8/1940 Jovy (Continued)

FOREIGN PATENT DOCUMENTS

CN 201348912 Y 11/2009
CN 103077803 A 5/2013

(Continued)

OTHER PUBLICATIONS

Dong et al., "The Short Winding Path Coupled Inductor Voltage Regulators," APEC 2008, pp. 1446-1452, Feb. 2008.

(Continued)

*Primary Examiner* — Ronald Hinson
(74) *Attorney, Agent, or Firm* — Lathrop Gage LLP

(57) ABSTRACT

A low-profile coupled inductor includes a magnetic core and first and second windings. The magnetic core includes first and second end flanges, a winding form element, a first outer plate, and a first leakage post. The winding form element is disposed between and connects the first and second end flanges in a first direction. The first outer plate is disposed over and faces the first and second end flanges in a second direction. The first leakage post is disposed between the winding form element and the first outer plate in the second direction. The first winding is wound around the winding form element, between the first end flange and the first leakage post, and the second winding is wound around the winding form element, between the first leakage post and the second end flange. Each of the windings is wound around a common axis extending in the first direction.

6 Claims, 16 Drawing Sheets

Related U.S. Application Data

(60) Provisional application No. 62/120,264, filed on Feb. 24, 2015.

(51) Int. Cl.
*H01F 27/28* (2006.01)
*H01F 17/06* (2006.01)
*H01F 27/30* (2006.01)
*H01F 27/34* (2006.01)

(58) Field of Classification Search
USPC ..... 336/212
See application file for complete search history.

(56) References Cited

U.S. PATENT DOCUMENTS 2,403,393 A 7/1946 Peterson
3,878,495 A 4/1975 Thomas
4,488,136 A 12/1984 Hansen et al.
4,833,432 A * 5/1989 Ohtsu ..... H01F 27/02 335/212
5,003,277 A 3/1991 Sokai et al.
5,182,535 A 1/1993 Dhyanchand
5,436,818 A 7/1995 Barthold
5,731,666 A 3/1998 Folker et al.
5,737,203 A 4/1998 Barrett
5,847,518 A 12/1998 Ishiwaki
5,939,966 A 8/1999 Shin' Ei
6,018,468 A 1/2000 Archer et al.
6,060,977 A 5/2000 Yamamoto et al.
6,147,584 A 11/2000 Shin' Ei
6,348,848 B1 2/2002 Herbert
6,348,850 B1 * 2/2002 Kimura ..... H01F 17/045 336/200
6,362,986 B1 3/2002 Schultz et al.
6,714,428 B2 3/2004 Huang et al.
6,737,951 B1 5/2004 Decristofaro et al.
6,856,230 B2 2/2005 Lu
6,873,237 B2 3/2005 Chandrasekaran et al.
6,967,553 B2 11/2005 Jitaru
6,970,077 B2 12/2005 Chandrasekaran et al.
7,046,523 B2 5/2006 Sun et al.
7,199,695 B1 4/2007 Zhou et al.
7,259,648 B2 8/2007 Matsutani et al.
7,280,026 B2 10/2007 Chandrasekaran et al.
7,292,128 B2 11/2007 Hanley
7,352,269 B2 4/2008 Li et al.
7,425,883 B2 9/2008 Matsutani et al.
7,463,208 B2 * 12/2008 Araki ..... H01Q 27/08 343/718
7,498,920 B2 3/2009 Sullivan et al.
7,525,408 B1 4/2009 Li et al.
7,567,163 B2 7/2009 Dadafshar et al.
7,633,369 B2 12/2009 Chandrasekaran et al.
7,649,434 B2 1/2010 Xu et al.
7,746,209 B1 6/2010 Li et al.
7,772,955 B1 8/2010 Li et al.
7,821,375 B2 10/2010 Dong et al.
7,864,016 B1 1/2011 Li et al.
7,880,577 B1 2/2011 Glaser et al.
7,893,806 B1 2/2011 Li et al.
7,893,378 B2 3/2011 Stratakos et al.
7,965,165 B2 6/2011 Ikriannikov et al.
7,994,888 B2 8/2011 Ikriannikov
8,040,212 B2 10/2011 Ikriannikov
8,102,233 B2 1/2012 Ikriannikov
8,134,443 B2 3/2012 Chandrasekaran et al.
8,174,348 B2 5/2012 Ikriannikov
8,237,530 B2 8/2012 Ikriannikov
8,294,544 B2 10/2012 Ikriannikov et al.
8,299,882 B2 10/2012 Ikriannikov
8,299,885 B2 10/2012 Ikriannikov et al.
8,330,567 B2 12/2012 Ikriannikov et al.
8,350,658 B1 1/2013 Stratakos et al.
8,362,867 B2 1/2013 Ikriannikov
8,416,043 B2 4/2013 Ikriannikov
8,487,604 B2 7/2013 Ikriannikov et al.
8,570,009 B2 10/2013 Wei et al.
8,638,187 B2 1/2014 Ikriannikov
8,674,798 B2 3/2014 Ikriannikov
8,674,802 B2 3/2014 Ikriannikov
8,716,991 B1 5/2014 Ikriannikov
8,772,967 B1 7/2014 Ikriannikov et al.
8,779,885 B2 7/2014 Li et al.
8,786,395 B2 7/2014 Li et al.
8,836,461 B2 9/2014 Li et al.
8,836,463 B2 9/2014 Ikriannikov et al.
8,847,722 B2 9/2014 Li et al.
8,866,580 B2 * 10/2014 Hasegawa ..... H02M 3/1584 336/182
8,890,644 B2 11/2014 Ikriannikov
8,952,776 B2 2/2015 Ikriannikov
8,975,995 B1 3/2015 Ikriannikov
9,013,259 B2 4/2015 Ikriannikov
9,019,063 B2 4/2015 Ikriannikov
9,083,332 B2 7/2015 Ikriannikov et al.
2002/0021201 A1 * 2/2002 Ol ..... H01F 3/14 336/197
2004/0085173 A1 5/2004 Decristofaro et al.
2004/0113741 A1 6/2004 Li et al.
2004/0130426 A1 7/2004 Suzuki
2005/0024179 A1 2/2005 Chandrasekaran et al.
2005/0258926 A1 * 11/2005 Weger ..... H01F 17/045 336/212
2006/0145800 A1 7/2006 Dadafshar et al.
2006/0197510 A1 9/2006 Chandrasekaran
2006/0290458 A1 * 12/2006 Sano ..... H01F 3/12 336/212
2007/0120758 A1 * 5/2007 Takahashi ..... G04G 21/04 343/788
2008/0024259 A1 1/2008 Chandrasekaran et al.
2008/0150666 A1 6/2008 Chandrasekaran et al.
2008/0169769 A1 7/2008 Lee
2008/0303624 A1 12/2008 Yamada et al.
2008/0309299 A1 12/2008 Wei et al.
2010/0007457 A1 1/2010 Yan et al.
2012/0056704 A1 3/2012 Nagano et al.
2012/0062207 A1 3/2012 Ikriannikov
2012/0274433 A1 11/2012 Matsumoto et al.
2012/0293293 A1 * 11/2012 Huang ..... H01F 3/14 336/212
2013/0127434 A1 5/2013 Ikriannikov
2014/0062446 A1 3/2014 Ikriannikov
2014/0085035 A1 * 3/2014 Kim ..... H01F 27/38 336/212
2014/0266086 A1 9/2014 Ikriannikov
2014/0313002 A1 * 10/2014 Kuo ..... H01F 27/24 336/178
2015/0235754 A1 8/2015 Ikriannikov
2015/0287512 A1 * 10/2015 Winkler ..... H01F 27/24 336/178

FOREIGN PATENT DOCUMENTS

EP 0 755 060 1/1997
JP 2009224649 10/2009
SU 708426 A1 1/1980
SU 1352591 A1 11/1987
SU 1515212 A1 10/1989
WO WO 2006/026674 3/2006
WO WO 2012093040 A1 7/2012

OTHER PUBLICATIONS

Wong et al, "Performance Improvements of Interleaving VRMs with Coupling Inductors," IEEE Trans. on Power Electronics, vol. 16, No. 4, Jul. 2001, pp. 499-507.

International Search Report and Written Opinion corresponding to International Patent Application No. PCT/US2016/019409, dated May 19, 2016, 6 pages.

(56) References Cited

OTHER PUBLICATIONS

Chinese Patent Application No. 201680022401.4, English translation of Office Action dated Oct. 12, 2018, 9 pages.

* cited by examiner

LOW-PROFILE COUPLED INDUCTORS WITH LEAKAGE CONTROL

RELATED APPLICATIONS

This application is a divisional of U.S. patent application Ser. No. 14/867,942, filed Sep. 28, 2015, which claims benefit of priority to U.S. provisional patent application Ser. No. 62/120,264, filed Feb. 24, 2015. Each of the aforementioned applications is incorporated herein by reference.

BACKGROUND

Mobile electronic devices such as mobile telephones and tablet computers require extensive power management circuitry. For example, mobile electronic devices often include multiple switching power converters, such as for controlling battery charging and for providing point-of-load regulation for processors and other integrated circuits. Power management circuitry often occupies a signification portion, e.g., up to 40%, of a mobile electronic device's volume.

Switching power converters typically include one or more inductors to store energy in magnetic form. For example, a buck DC-to-DC converter includes an inductor as part of an output filter for removing AC components from the converter's switching waveform. Inductors are typically among the largest components within DC-to-DC converters. Therefore, it is desirable to minimize inductor size. However, it is difficult to reduce inductor size without degrading inductor performance and/or significantly increasing inductor cost. For example, reducing the cross-sectional area of an inductor's magnetic core typically increases the magnetic core's reluctance, thereby increasing core losses. As another example, decreasing winding cross-sectional area increases the winding's DC resistance, thereby increasing copper losses.

It is known that a single coupled inductor can replace multiple discrete inductors in a switching power converter, to improve converter performance, reduce converter size, and/or reduce converter cost. Examples of coupled inductors and associated systems and methods are found in U.S. Pat. No. 6,362,986 to Schultz et al., which is incorporated herein by reference. Some examples of coupled inductor structures are found in U.S. Patent Application Publication Number 2004/0113741 to Li et al., which is also incorporated herein by reference.

In contrast to discrete inductors, coupled inductors have two distinct inductance values, i.e., magnetizing inductance and leakage inductance. Magnetizing inductance is associated with magnetic coupling of the windings and results from magnetic flux generated by current flowing through one winding linking each other winding of the coupled inductor. Leakage inductance, on the other hand, is associated with energy storage and results from magnetic flux generated by current flowing through one winding not linking any of the other windings of the coupled inductor. Both magnetizing inductance and leakage inductance are important parameters in switching power converter applications of coupled inductors. Specifically, leakage inductance values typically must be within a limited range of values to achieve an acceptable tradeoff between low ripple current magnitude and adequate converter transient response. The magnetizing inductance value, on the other hand, typically must be significantly larger than the leakage inductance values to achieve sufficiently strong magnetic coupling of the windings, to realize the advantages of using a coupled inductor instead of multiple discrete inductors.

While use of a coupled inductor in a switching power converter offers many advantages, conventional coupled inductors typically having a higher profile (height) than discrete inductor counterparts. Many mobile electronic devices, though, have stringent low-profile requirements, often dictating that component profile not exceed one millimeter. Therefore, coupled inductor have not obtained large market share in low-profile applications. Additionally, conventional coupled inductors are often more expensive than discrete inductors having similar properties, and therefore coupled inductors are not widely used in low-current, i.e., less than 10 amperes per phase, applications.

SUMMARY

In an embodiment, a low-profile coupled inductor includes a magnetic core, a first winding, and a second winding. The magnetic core includes first and second end flanges, a winding form element, a first outer plate, and a first leakage post. The winding form element is disposed between and connects the first and second end flanges in a first direction. The first outer plate is disposed over and faces the first and second end flanges in a second direction, where the second direction is orthogonal to the first direction. The first leakage post is disposed between the winding form element and the first outer plate in the second direction. The first winding is wound around the winding form element, between the first end flange and the first leakage post, and the second winding is wound around the winding form element, between the first leakage post and the second end flange. Each of the first and second windings is wound around a common axis extending in the first direction.

In an embodiment, a low-profile coupled inductor includes a magnetic core, a first winding, and a second winding. The magnetic core includes first and second end flanges, a winding form element, an outer plate, and a first leakage post. The winding form element is disposed between and connects the first and second end flanges in a first direction. The outer plate at least partially surrounds each of the first and second end flanges and the winding form element, as seen when the low-profile coupled inductor is viewed cross-sectionally in the first direction. The first leakage post is disposed between the winding form element and the outer plate. The first winding is wound around the winding form element, between the first end flange and the first leakage post, and the second winding is wound around the winding form element, between the leakage post and the second end flange. Each of the first and second windings is wound around a common axis extending in the first direction.

In an embodiment, a low-profile coupled inductor includes a magnetic core, a first winding, and a second winding. The magnetic core includes first and second end flanges, a winding form element, and a first outer plate. The winding form element is disposed between and connects the first and second end flanges in a first direction. The first outer plate is disposed over and faces the first and second end flanges in a second direction, where the second direction is orthogonal to the first direction. The first winding is wound around the winding form element, and the second winding is wound around the winding form element. Each of the first and second windings is wound around a common axis extending in the first direction.

DETAILED DESCRIPTION OF THE EMBODIMENTS

Applicant has developed low-profile coupled inductors which at least potentially overcome one or more of the disadvantages of conventional coupled inductors discussed above. Certain embodiments of the low-profile coupled inductors have a profile of less than 1 mm and are therefore potentially suitable for use in applications with stringent low-profile requirements, such as mobile telephone and tablet computer applications. Additionally, certain embodiments of the low-profile coupled inductors allow windings to be wound directly on the magnetic core, thereby promoting manufacturing simplicity, low manufacturing cost, low material cost, and ease of forming multiple turns. Furthermore, the low-profile coupled inductors advantageously allow leakage inductance to be adjusted substantially independently of magnetizing inductance during coupled inductor design and/or manufacture.

Figure 1:
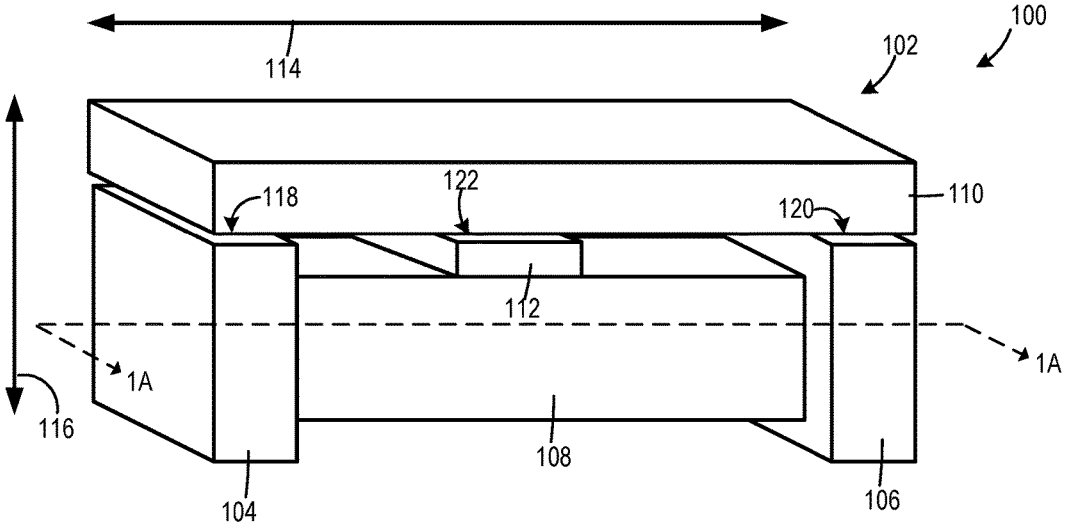
FIG. 1 shows a perspective view of a low-profile coupled inductor, according to an embodiment.
Figure 2:
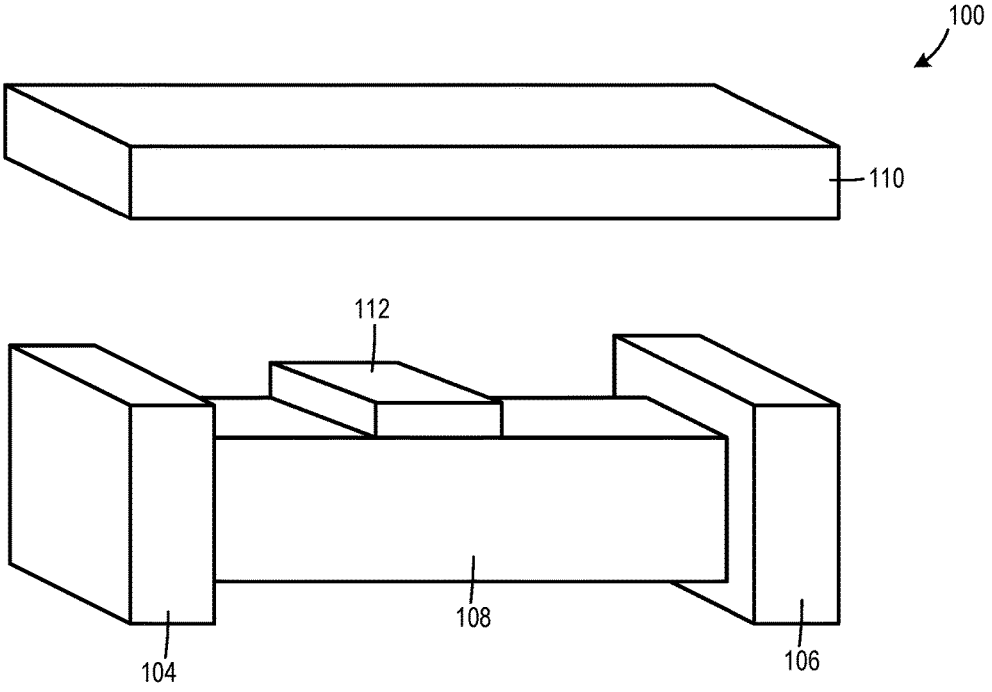
FIG. 2 shows an exploded perspective view of the FIG. 1 low-profile coupled inductor.
Figure 3:
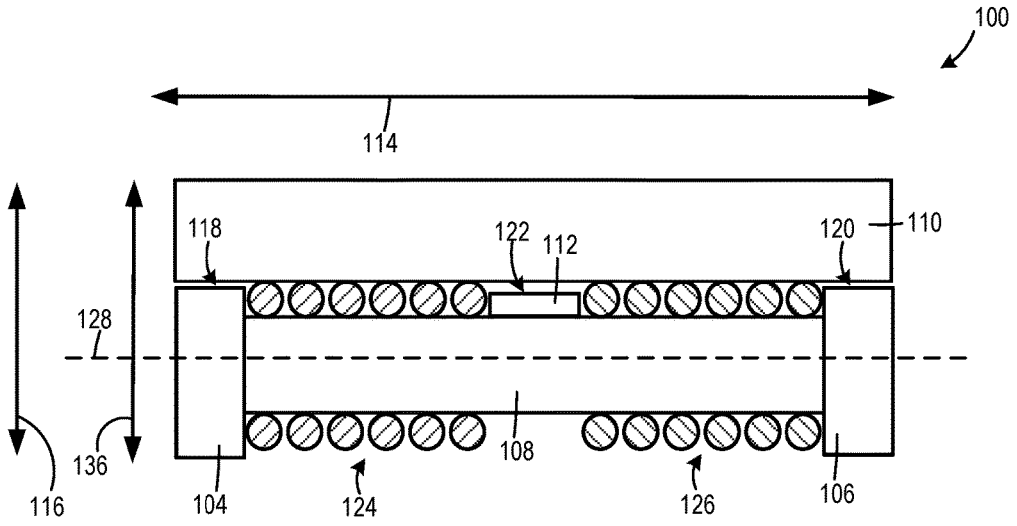
FIG. 3 shows a cross-sectional view of the FIG. 1 low-profile coupled inductor taken along line 1A-1A of FIG. 1.

FIG. 1 shows a perspective view of a low-profile coupled inductor 100 with leakage control. FIG. 2 shows an exploded perspective view of coupled inductor 100, and FIG. 3 shows a cross-sectional view of coupled inductor 100 taken along line 1A-1A of FIG. 1. Coupled inductor 100 includes a magnetic core 102 including a first end flange 104, a second end flange 106, a winding form element 108, a first outer plate 110, and a first leakage post 112. First end flange 104 and second end flange 106 are separated from each other in a first direction 114, and winding form element 108 is disposed between and connects first and second end flanges 104 and 106 in first direction 114. First outer plate 110 is disposed over and faces first and second end flanges 104 and 106 in a second direction 116, orthogonal to first direction 114. First leakage post 112 is attached to winding form element 108, such that first leakage post 112 is disposed between winding form element 108 and first outer plate 110 in second direction 116. First end flange 104 is separated from first outer plate 110 in second direction 116 by a first magnetizing gap 118, and second end flange 106 is separated from first outer plate 110 by a second magnetizing gap 120 in second direction 116. First leakage post 112 is separated from first outer plate 110 by a first leakage gap 122 in second direction 116. In some alternate embodiments, such as embodiments where magnetic core 102 is formed of magnetic material having a distributed gap, one or more of first magnetizing gap 118, second magnetizing gap 120, and first leakage gap 122 are omitted. First leakage post 112 could be replaced with two or more leakage posts, such as respective leakage posts coupled to each of winding form element 108 and first outer plate 110, without departing from the scope hereof.

In some embodiments, magnetic core 102 is a homogenous core, i.e., each of first and second end flanges 104 and 106, winding form element 108, first outer plate 110, and first leakage post 112 are formed of the same magnetic material, such as a ferrite magnetic material. However, in some other embodiments, magnetic core 102 is a non-homogenous core, i.e., two or more of its elements are formed of different magnetic materials. For example, in a particular embodiment, first and second end flanges 104 and 106, winding forming element 108, and first leakage post 112 are formed of a ferrite magnetic material, while first outer plate 110 is formed of a magnetic paste. Although the various components of magnetic core 102 are delineated in the figures to help a viewer distinguish these elements, lines separating elements of magnetic core 102 do not necessarily represent discontinuities in magnetic core 102. For example, first and second end flanges 104 and 106 and winding form element 108 could be part of a single monolithic magnetic structure.

Low-profile coupled inductor 100 further includes a first winding 124 and a second winding 126 each wound around a common axis 128 extending in first direction 114 (see FIG. 3). First and second windings 124 and 126 are not shown in the perspective views of FIGS. 1 and 2, to better show magnetic core 102. First winding 124 is wound around winding form element 108, between first end flange 104 and first leakage post 112, and second winding 126 is wound around winding form element 108, between first leakage post 112 and second end flange 106. Although first and second windings 124 and 126 are each illustrated as forming six turns around common axis 128, the number of turns formed by each winding could vary without departing from the scope hereof. For example, in one alternate embodiment, each of first and second windings 124 and 126 forms only a single turn around common axis 128.

Figure 4:
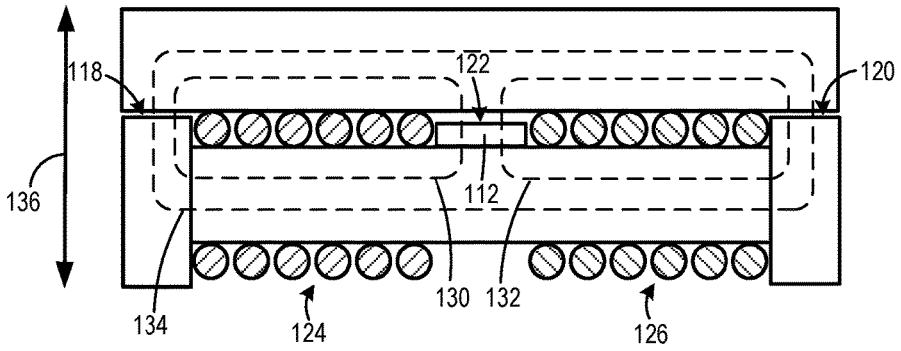
FIG. 4 shows a cross-sectional view of the FIG. 1 low-profile coupled inductor illustrating approximate magnetic flux paths.

FIG. 4 is a cross-sectional view like that of FIG. 3, but further illustrating approximate magnetic flux paths in low-profile coupled inductor 100. Leakage magnetic flux 130 associated with first winding 124, as well as leakage magnetic flux 132 associated with second winding 126, flows through first leakage post 112 and first leakage gap 122. Consequentially, leakage inductance values can be adjusted during design and/or manufacture of low-profile coupled inductor 100 simply by adjusting the configuration of first leakage post 112 and/or first leakage gap 122. For example, if an increase in leakage inductance values is desired, magnetic permeability of first leakage post 112 can be increased, cross-sectional area of first leakage post 112 can be increased, and/or thickness of first leakage gap 122, in second direction 116, can be decreased. It should be appreciated that these multiple avenues for adjusting leakage inductance values enable fine control of leakage inductance values, which may be of particular benefit since leakage inductance is a critical parameter in switching power converter applications, as discussed above. In many conventional coupled inductors, in contrast, it is difficult to finely control leakage inductance values.

It should further be appreciated that magnetizing flux 134, which links both of first winding 124 and second winding 126, does not flow through first leakage post 112 or first leakage gap 122. Consequently, leakage inductance values can advantageously be adjusted independently of magnetizing inductance values, by adjusting the configuration of first leakage post 112 and/or first leakage gap 122. Thickness of first magnetizing gap 118 and second magnetizing gap 120, in second direction 116, can be selected to achieve a desired magnetizing inductance and/or resistance to magnetic saturation. For example, thickness of first magnetizing gap 118 and thickness of second magnetizing gap 120 can be decreased to increase the value of magnetizing inductance. As another example, thickness of first magnetizing gap 118 and thickness of second magnetizing gap 120 can be increased to reduce likelihood of magnetic saturation at high current levels. It is anticipated that the respective thicknesses of first magnetizing gap 118 and second magnetizing gap 120 will typically be smaller than thickness of first leakage gap 122.

Low-profile coupled inductor 100 may achieve additional advantages. For example, winding form element 108 has a low profile 136, as can be seen in the cross-sectional view of FIG. 3, thereby minimizing length and associated resistance of first and second windings 124 and 126, while also helping minimize profile 136 of coupled inductor 100. In some embodiments, profile 136 is less than one millimeter. Additionally, there is little separation between first outer plate 110 and the remainder of magnetic core 102, which also helps minimize profile 136. Furthermore, the fact that both first winding 124 and second winding 126 are wound around common axis 128 potentially enables both windings to be simultaneously wound, thereby promoting manufacturing efficiency and simplicity. Moreover, first end flange 104, first leakage post 112, and second end flange 106 help confine first winding 124 and second winding 126 to their respective positions on winding form element 108, thereby reducing, or even eliminating, the need for additional features to control winding position. Additionally, the fact that first and second windings 124 and 126 are wound around a portion of magnetic core 102, instead of embedded in the magnetic core, allows greater flexibility in choosing magnetic material forming magnetic core 102, thereby allowing, for example, use of a ferrite magnetic material. Furthermore, leakage post 112 helps prevent current crowding, and associated resistance, in first and second windings 124 and 126.

The configuration of magnetic core 102 also advantageously allows 360-degree access to winding form element 108 before first outer plate 110 is installed, thereby potentially enabling first and second windings 124 and 126 to be wound directly on magnetic core 102, such as by rotating magnetic core 102 around common axis 128. In many conventional coupled inductors, in contrast, the magnetic core blocks access to at least part of the core's winding portion, necessitating that windings be wound separately from the magnetic core and subsequently installed on the magnetic core. Additionally, the ability to wind first and second windings 124 and 126 directly on magnetic core 102 facilitates forming the windings with multiple turns, to achieve large inductance values. It can be difficult or impossible to form windings with multiple turns, however, on some conventional coupled inductors that require that windings be wound separate from the magnetic core.

Figure 5:
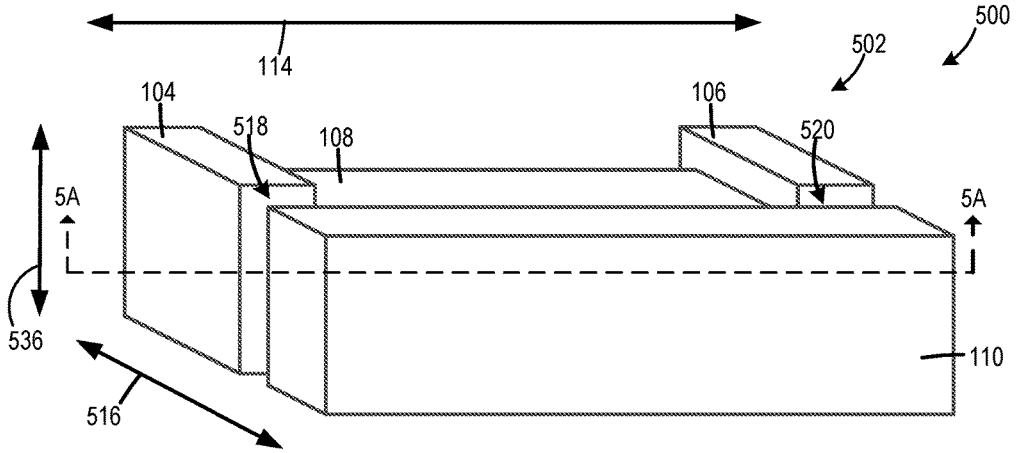
FIG. 5 shows a perspective view of another low-profile coupled inductor, according to an embodiment.
Figure 6:
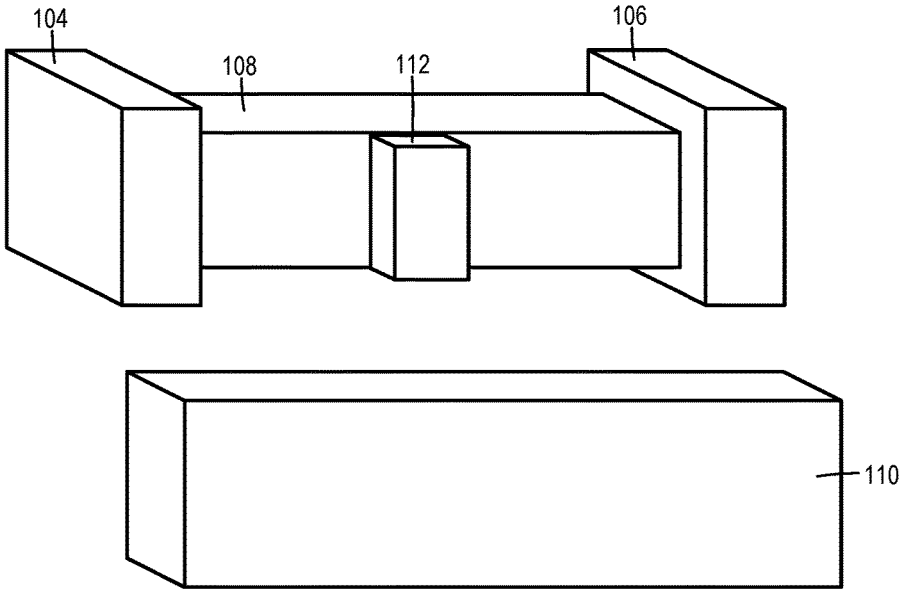
FIG. 6 shows an exploded perspective view of the FIG. 5 low-profile coupled inductor.
Figure 7:
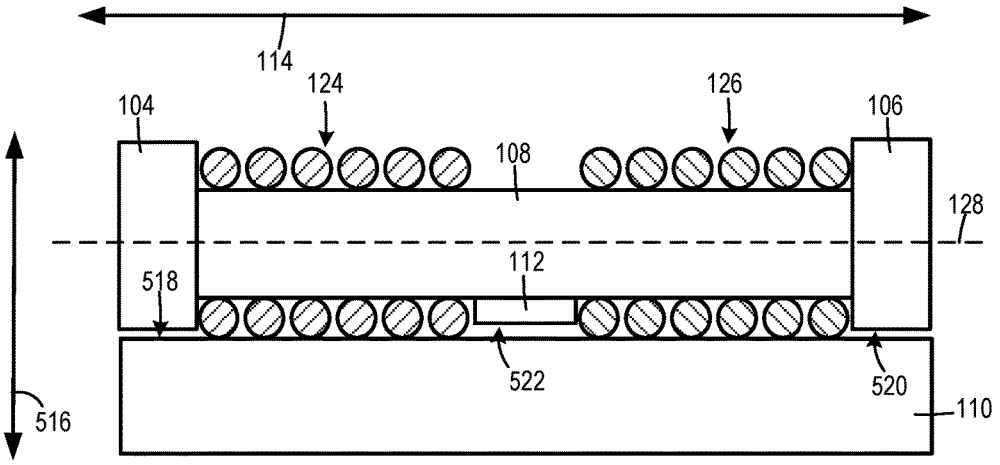
FIG. 7 shows a cross-sectional view of the FIG. 5 low-profile coupled inductor taken along line 5A-5A of FIG. 5.

FIG. 5 is a perspective view of a low-profile coupled inductor 500, which is similar to low-profile coupled inductor 100 of FIG. 1, but with different locations of first outer plate 110 and first leakage post 112. Specifically, coupled inductor 500 includes a magnetic core 502, which is like magnetic core 102, but with first outer plate 110 and first leakage post 112 disposed on the side, instead of on the top, of winding form element 108. FIG. 6 shows an exploded perspective view of coupled inductor 500, and FIG. 7 shows a cross-sectional view of coupled inductor 500 taken along line 5A-5A of FIG. 5. First outer plate 110 is disposed over and faces first and second end flanges 104 and 106 in a second direction 516, orthogonal to first direction 114. First end flange 104 is separated from first outer plate 110 in second direction 516 by a first magnetizing gap 518, and second end flange 106 is separated from first outer plate 110 by a second magnetizing gap 520 in second direction 516. First leakage post 112 is separated from first outer plate 110 by a first leakage gap 522 in second direction 516. First and second windings 124 and 126 are not shown in the perspective views of FIGS. 5 and 6, but the windings are visible in the cross-sectional view of FIG. 7. The fact that first outer plate 110 and first leakage post 112 are disposed on the side, instead of on the top, of winding form element 108 may result in a profile 536 of coupled inductor 500 being smaller than profile 136 of coupled inductor 100, assuming otherwise identical configuration.

Figure 8:
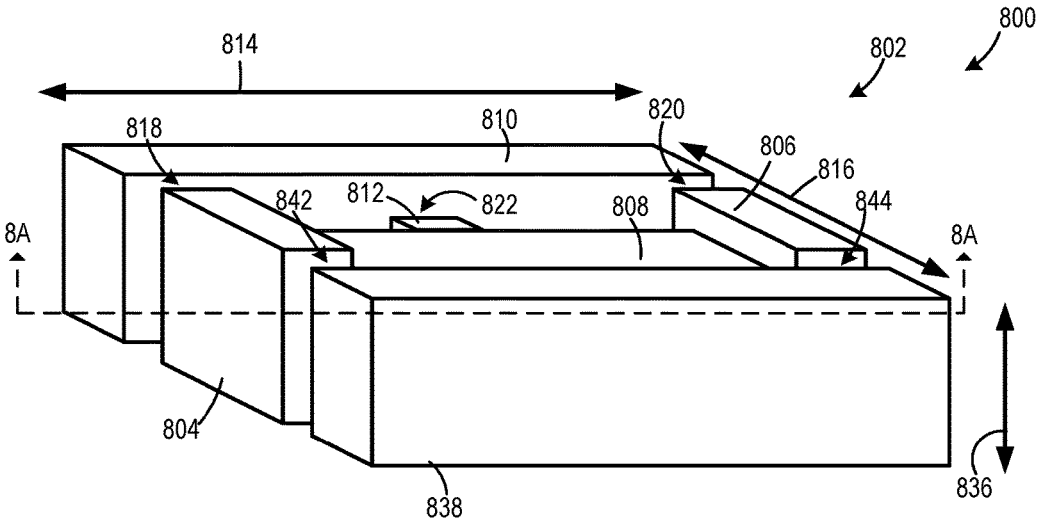
FIG. 8 shows a perspective view of a low-profile coupled inductor including two outer plates, according to an embodiment.
Figure 9:
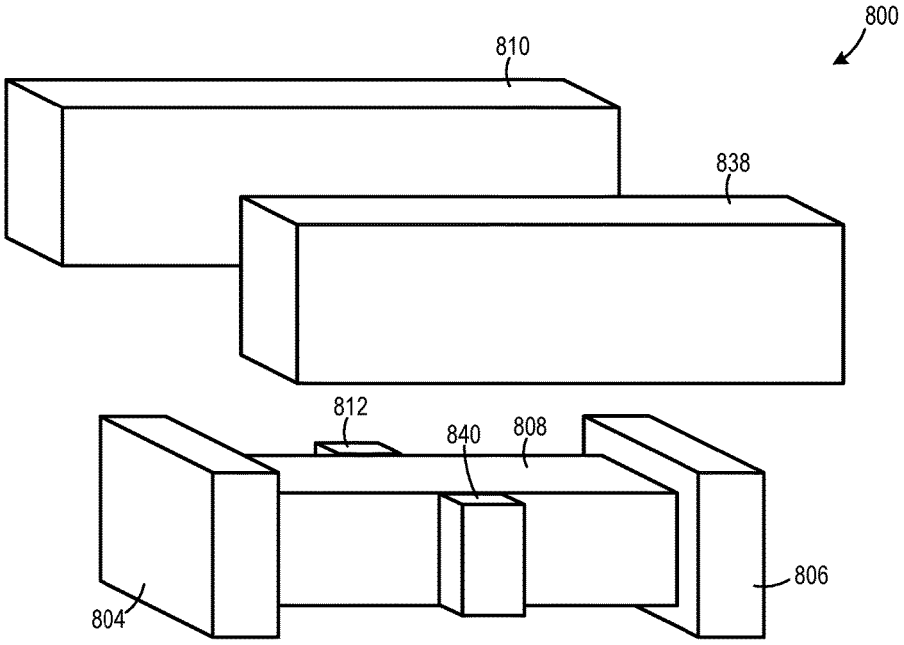
FIG. 9 shows an exploded perspective view of the FIG. 8 low-profile coupled inductor.
Figure 10:
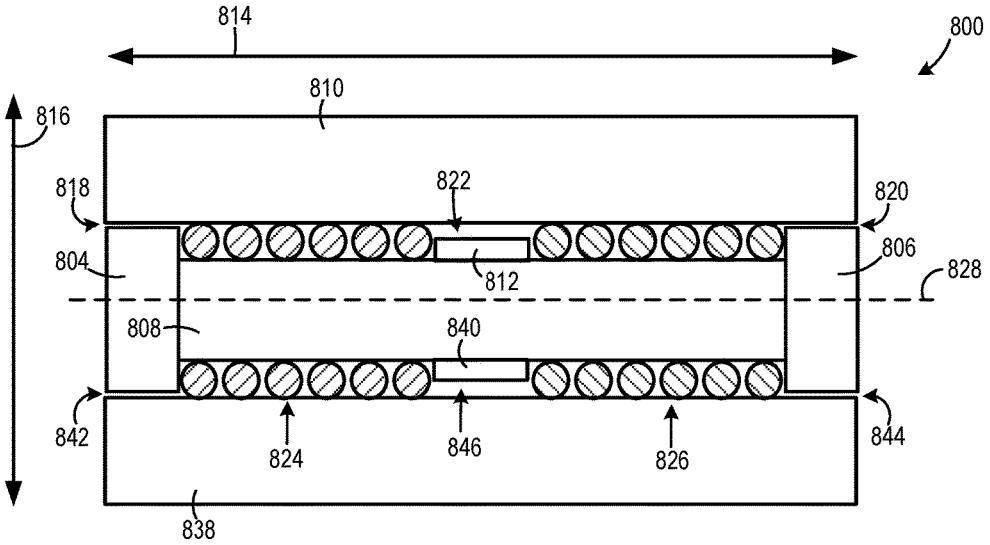
FIG. 10 shows a cross-sectional view of the FIG. 8 low-profile coupled inductor taken along line 8A-8A of FIG. 8.

Either of low-profile coupled inductor 100 or 500 could be modified to include a second outer plate analogous to first outer plate 110, but disposed on the opposite side of winding form element 108 from first outer plate 110. For example, FIG. 8 shows a perspective view of a low-profile coupled inductor 800 including two outer plates. FIG. 9 show an exploded perspective view of coupled inductor 800, and FIG. 10 shows a cross-sectional view of coupled inductor 800 taken along line 8A-8A of FIG. 8. In some embodiments, low-profile coupled inductor 800 has a profile 836 of less than one millimeter.

Coupled inductor 800 includes a magnetic core 802 including a first end flange 804, a second end flange 806, a winding form element 808, a first outer plate 810, a second outer plate 838, a first leakage post 812, and a second leakage post 840. First end flange 804 and second end flange 806 are separated from each other in a first direction 814, and winding form element 808 is disposed between and connects first and second end flanges 804 and 806 in first direction 814. First outer plate 810 and second outer plate 838 are disposed on opposite sides of winding form element 808, such that each outer plate 810 and 838 is disposed over and faces first and second end flanges 804 and 806 in a second direction 816, orthogonal to first direction 814. First leakage post 812 is attached to winding form element 808, such that first leakage post 812 is disposed between winding form element 808 and first outer plate 810 in second direction 816. Similarly, second leakage post 840 is attached to winding form element 808, such that second leakage post 840 is disposed between winding form element 808 and second outer plate 838 in second direction 816. One or both of first leakage post 812 and second leakage post 840 could each be replaced with two or more leakage posts, without departing from the scope hereof.

First end flange 804 is separated from first outer plate 810 in second direction 816 by a first magnetizing gap 818, and second end flange 806 is separated from first outer plate 810 by a second magnetizing gap 820 in second direction 816. Similarly, first end flange 804 is separated from second outer plate 838 in second direction 816 by a third magnetizing gap 842, and second end flange 806 is separated from second outer plate 838 by a second magnetizing gap 844 in second direction 816. First leakage post 812 is separated from first outer plate 810 by a first leakage gap 822 in second direction 816, and second leakage post 840 is separated from second outer plate 838 by a second leakage gap 846 in second direction 816. In some alternate embodiments, such as embodiments where magnetic core 802 is formed of magnetic material having a distributed gap, one or more of first magnetizing gap 818, second magnetizing gap 820, third magnetizing gap 842, fourth magnetizing gap 844, first leakage gap 822, and second leakage gap 846 are omitted. Although the various components of magnetic core 802 are delineated in the figures to help a viewer distinguish these elements, lines separating elements of magnetic core 802 do not necessarily represent discontinuities in magnetic core 802. For example, first and second end flanges 804 and 806 and winding form element 808 could be part of a single monolithic magnetic structure.

Low-profile coupled inductor 800 further includes a first winding 824 and a second winding 826 each wound around a common axis 828 extending in first direction 814 (see FIG. 10). First and second windings 824 and 826 are not shown in the perspective views of FIGS. 8 and 9 to better show magnetic core 802. First winding 824 is wound around winding form element 808, between first end flange 804 and first and second leakage posts 812 and 840, and second winding 826 is wound around winding form element 808, between first and second leakage posts 812 and 840 and second end flange 806. Although first and second windings 824 and 826 are each illustrated as forming six turns around common axis 828, the number of turns formed by each winding could vary without departing from the scope hereof.

Figure 11:
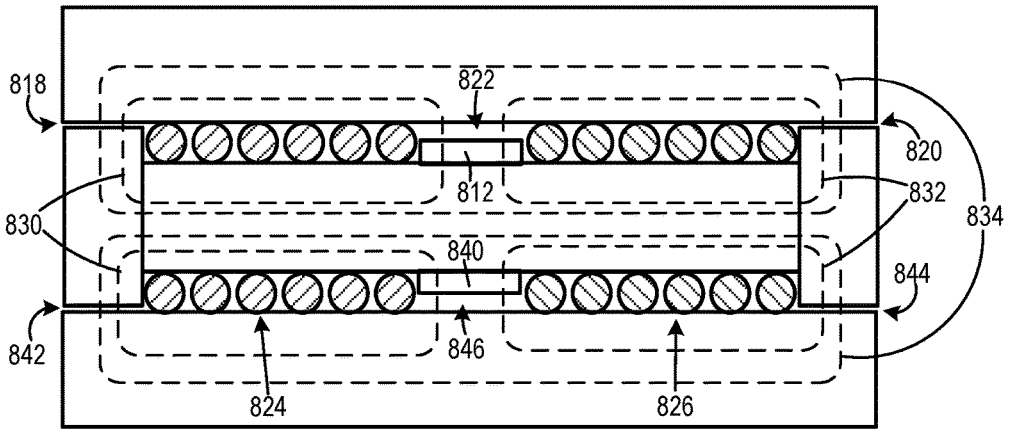
FIG. 11 shows a cross-sectional view of the FIG. 8 low-profile coupled inductor illustrating approximate magnetic flux paths.

FIG. 11 is a cross-sectional view like that of FIG. 10, but further illustrating approximate magnetic flux paths in low-profile coupled inductor 800. Leakage magnetic flux 830 associated with first winding 824, as well as leakage magnetic flux 832 associated with second winding 826, both flow through first leakage post 812, first leakage gap 822, second leakage post 840, and second leakage gap 846. Magnetizing flux 834, on the other hand, does not flow through any of first leakage post 812, first leakage gap 822, second leakage post 840, or second leakage gap 846. Consequentially, leakage inductance values of low-profile coupled inductor 800 can advantageously be adjusted during design and/or manufacture, independent of magnetizing inductance, simply by adjusting the configuration of first leakage post 812, first leakage gap 822, second leakage post 840, and/or second leakage gap 846. For example, leakage inductance could be decreased by increasing the thickness of first and/or second leakage gaps 822 and 846 in second direction 816. Magnetizing inductance could be adjusted by adjusting the configuration of first magnetizing gap 818, second magnetizing gap 820, third magnetizing gap 842, and/or fourth magnetizing gap 844. For example, magnetizing inductance could be decreased by increasing the thickness of first magnetizing gap 818, second magnetizing gap 820, third magnetizing gap 842, and/or fourth magnetizing gap 844, in second direction 816.

Use of dual first and second outer plates 810 and 838, instead of just a single outer plate, provides dual paths for magnetic flux. Consequentially, low-profile coupled inductor 800 will have lower core losses and more even flux density distribution than coupled inductor 100 or 500, assuming all three coupled inductors haves similar leakage inductance values, magnetizing inductance values, and case sizes.

Applicant has additionally discovered that it may be advantageous to split control of magnetizing gap thickness and leakage gap thickness between the winding form element and the outer plate(s). Splitting gap thickness control in such manner overcomes possible manufacturing difficulties associated with controlling multiple gap thicknesses from a single element.

Figure 12:
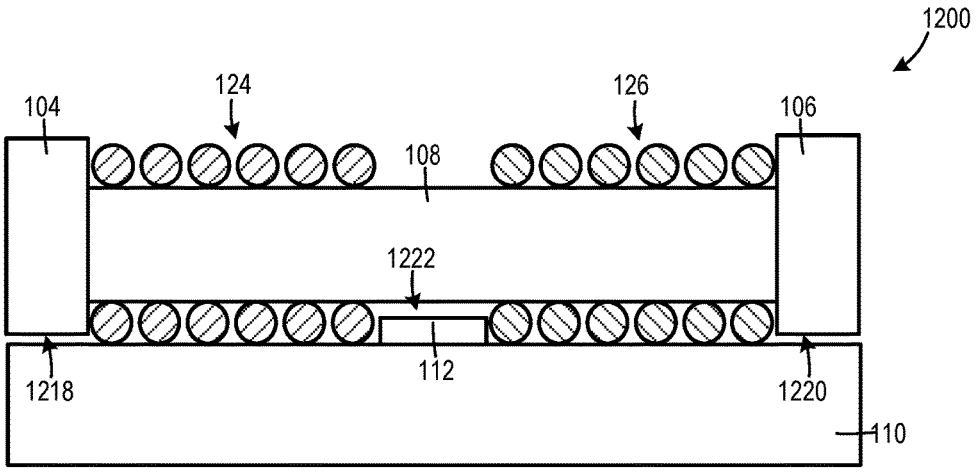
FIG. 12 is a cross-sectional view of a low-profile coupled inductor similar to that of FIG. 5, but with a first leakage post connected to a first outer plate, according to an embodiment.
Figure 13:
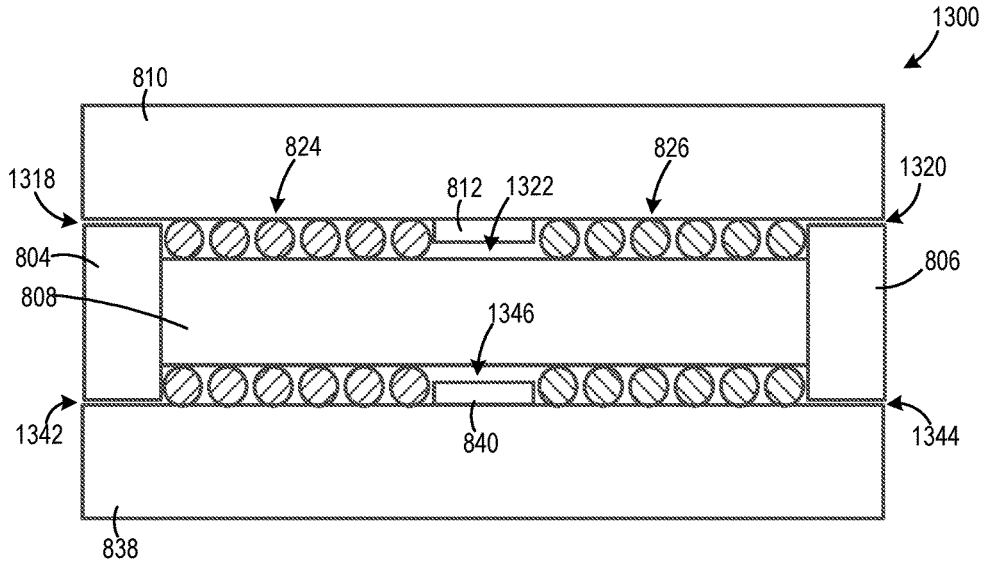
FIG. 13 is a cross-sectional view of a low-profile coupled inductor similar to that of FIG. 8, but with a first leakage post connected to a first outer plate and a second leakage post connected to a second outer plate, according to an embodiment.

FIGS. 12 and 13 each illustrate a respective example of splitting control of gap thickness between the winding form element and one or more plates. FIG. 12 is a cross-sectional view of a low-profile coupled inductor 1200, which is similar to low profile coupled inductor 500 of FIG. 5, but with first leakage post 112 connected to first outer plate 110 instead of to winding form element 108. This configuration splits control of gap thickness between winding form element 108 and first outer plate 110. Specifically, thickness of a first magnetizing gap 1218 and a second magnetizing gap 1220 are controlled by the configuration of winding form element 108, while control of a first leakage gap thickness 1222 is controlled by configuration of first outer plate 110.

FIG. 13 is a cross-sectional view of a low-profile coupled inductor 1300, which is similar to low-profile coupled inductor 800 of FIG. 8, but with first leakage post 812 connected to first outer plate 810, and second leakage post 840 connected to second outer plate 838, instead of with both first leakage post 812 and second leakage post 840 connected to winding form element 808. This configuration splits control of gap thickness between winding form element 808 and first and second outer plates 810 and 838. Specifically, thickness of magnetizing gaps 1318, 1320, 1342, and 1344 is controlled by the configuration of winding form element 808, while thickness of a leakage gaps 1322 and 1346 is controlled by configuration of first outer plate 810 and second outer plate 838.

The low profile coupled inductors discussed above could also be modified such that thickness of the magnetizing gaps is controlled by one or more outer plates. Such modifications, however, may reduce or eliminate the ability of the end flanges to control winding position.

Figure 14:
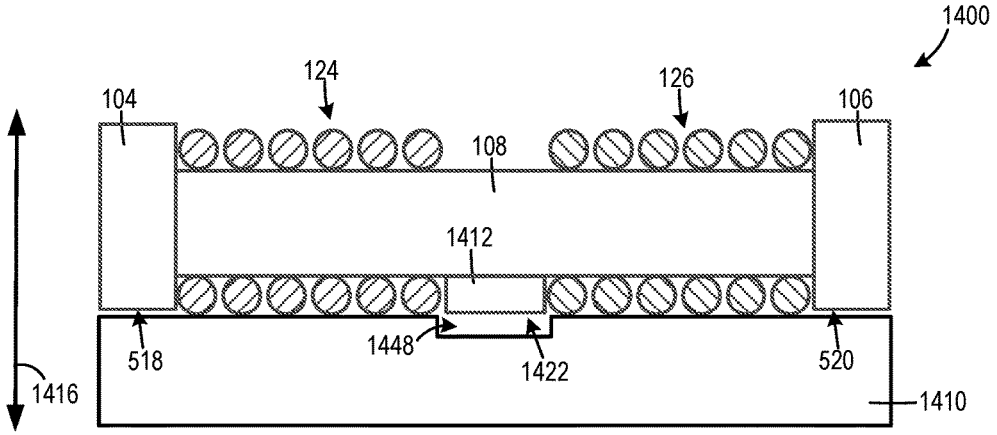
FIG. 14 is a cross-sectional view of a low-profile coupled inductor similar to that of FIG. 5, but with a first outer plate forming a recess, according to an embodiment.
Figure 15:
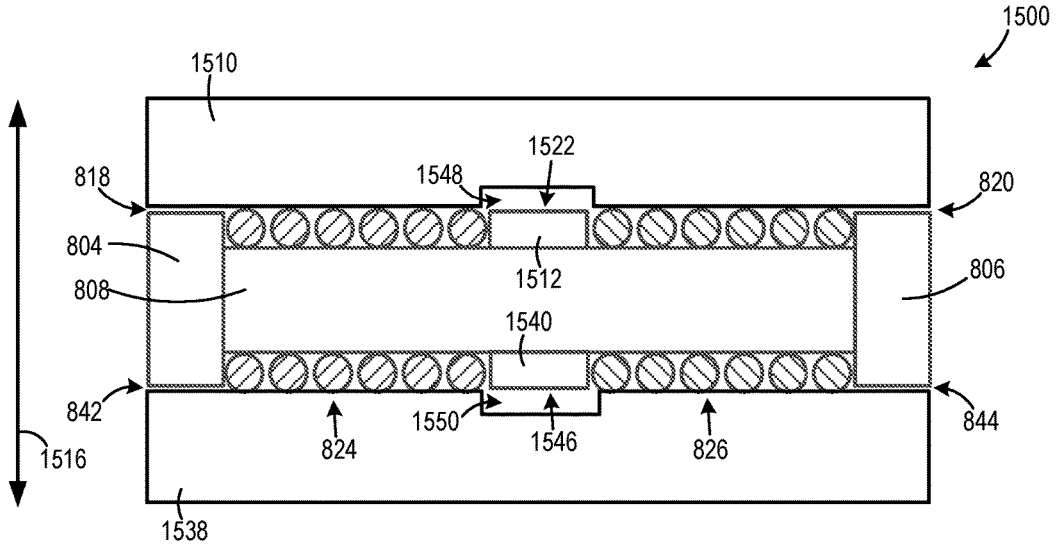
FIG. 15 is a cross-sectional view of a low-profile coupled inductor similar to that of FIG. 8, but with first and second outer plates forming respective recesses, according to an embodiment.

Applicant has further discovered that leakage gap thickness can be controlled at least partially by forming a recess in the outer plates. FIGS. 14 and 15 each illustrate a respective embodiment including an outer plate forming a recess. In particular, FIG. 14 is a cross-sectional view of a low-profile coupled inductor 1400, which is similar to low profile coupled inductor 500 of FIG. 5, but with first outer plate 110 replaced with a first outer plate 1410 forming a recess 1448 extending into first outer plate 1410 in a direction 1416. First leakage post 112 is also replaced with a first leakage post 1412, which is connected to winding form element 108 and faces recess 1448. Accordingly, a thickness of first leakage gap 1422, and thereby leakage inductance values of coupled inductor 1400, can be controlled by adjusting the configuration of winding form element 108 and/or first outer plate 1410.

FIG. 15 is a cross-sectional view of a low-profile coupled inductor 1500, which is similar to low profile coupled inductor 800 of FIG. 8, but with first outer plate 810 replaced with a first outer plate 1510 and second outer plate 838 replaced with second outer plate 1538. First outer plate 1510 forms a first recess 1548 extending into first outer plate 1510 in a direction 1516, and second outer plate 1538 forms a second recess 1550 extending into second outer plate 1538 in direction 1516. First leakage post 812 is also replaced with a first leakage post 1512, and second leakage post 840 is replaced with second leakage post 1540. First leakage post 1512 is connected to winding form element 808 and faces first recess 1548, and second leakage post 1540 is connected to winding form element 808 and faces second recess 1550. Accordingly, a thickness of first leakage gap 1522, and thereby the leakage inductance values of coupled inductor 1500, can be controlled by adjusting the configuration of winding form element 808 and/or first plate 1510. Similarly, a thickness of second leakage gap 1546, and thereby the leakage inductance values of coupled inductor 1500, can be controlled by adjusting the configuration of winding form element 808 and/or second plate 1538.

Figure 16:
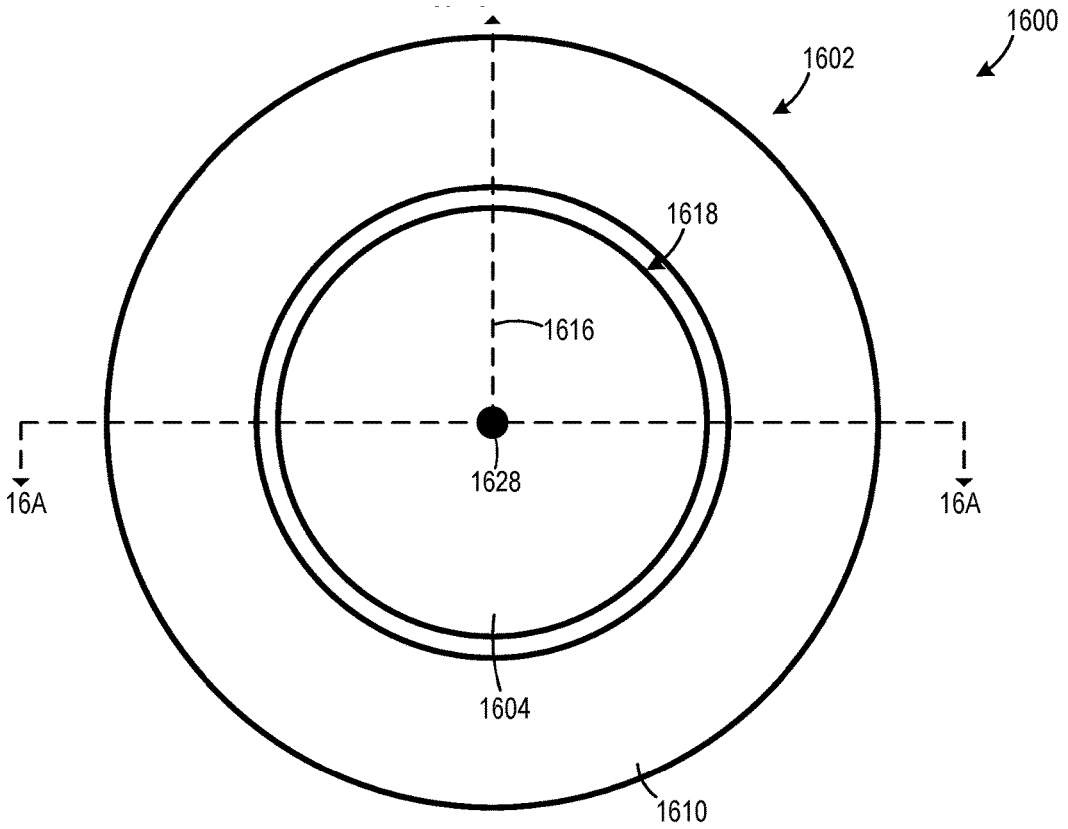
FIG. 16 is a top plan view of a low-profile coupled inductor including an outer plate surrounding a first end flange, a second end flange, and a winding form element, according to an embodiment.
Figure 17:
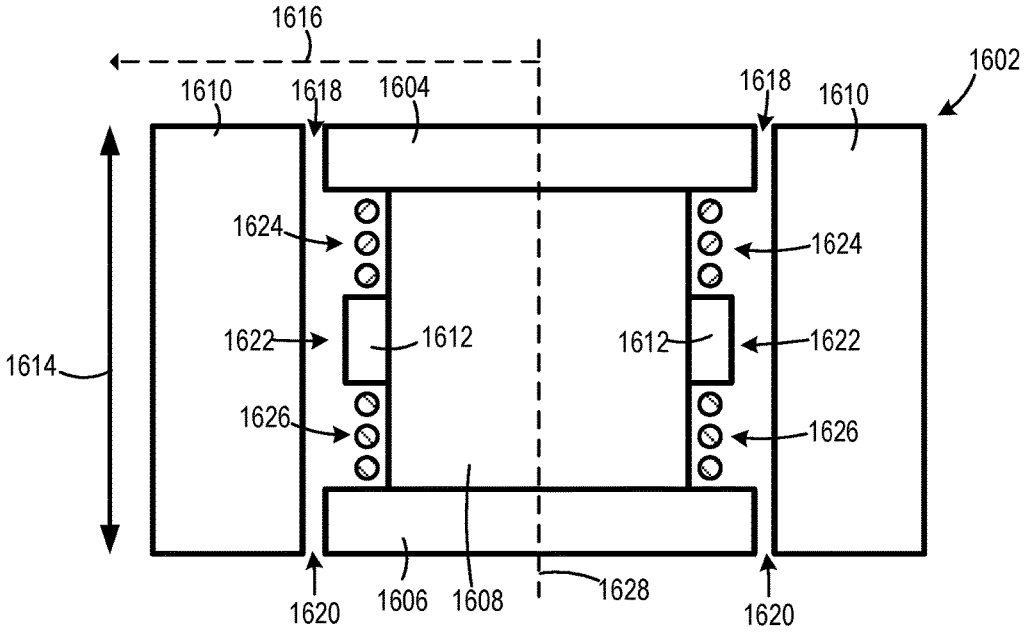
FIG. 17 is a cross-sectional view of the FIG. 16 low-profile coupled inductor taken along line 16A-16A of FIG. 16.

The low-profile coupled inductors discussed above could be modified to include an outer plate at least partially surrounding the end flanges and winding form element. This modification promotes low magnetic flux density and even magnetic flux density distribution in a manner similar to that of using two outer plates. FIGS. 16 and 17 illustrate one example of a low-profile coupled inductor including an outer plate surrounding the ends flanges and winding forming elements. FIG. 16 is a top plan view of a low-profile coupled inductor 1600, and FIG. 17 is a cross-sectional view of low-profile coupled inductor 1600 taken along line 16A-16A of FIG. 16.

Low profile coupled inductor 1600 includes a magnetic core 1602 including a first end flange 1604, a second end flange 1606, a winding forming element 1608, an outer plate 1610, and a first leakage post 1612. First end flange 1604 and second end flange 1606 are separated from each other in a first direction 1614, and winding form element 1608 is disposed between and connects first end flange 1604 and second end flange 1606 in first direction 1614. Each of first end flange 1604, second end flange 1606, and winding form element 1608 has a circular shape, as seen when low-profile coupled inductor 1600 is viewed cross-sectionally in first direction 1614. Outer plate 1610 has a tubular shape and surrounds each of first end flange 1604, second end flange 1606, and winding form element 1608, when low-profile coupled inductor 1600 is viewed cross-sectionally in first direction 1614. First leakage post 1612 is connected to winding form element 1608 and extends along an outer circumference of winding form element 1608, so that first leakage post 1612 forms a ring disposed between winding form element 1608 and outer plate 1610, as seen low-profile coupled inductor 1600 is viewed cross-sectionally in first direction 1614.

First end flange 1604 is separated from outer plate 1610 in a second direction 1616 by a first magnetizing gap 1618, where second direction 1616 extends radially from a center axis 1628 extending in first direction 1614. Additionally, second end flange 1606 is separated from outer plate 1610 by a second magnetizing gap 1620 in second direction 1616. First leakage post 1612, in turn, is separated from outer plate 1610 by a first leakage gap 1622 in second direction 1616. In some alternate embodiments, such as embodiments where magnetic core 1602 is formed of magnetic material having a distributed gap, one or more of first magnetizing gap 1618, second magnetizing gap 1620, and first leakage gap 1622 are omitted. First leakage post 1612 could be replaced with two or more leakage posts, such as respective leakage posts coupled to each of winding form element 1608 and outer plate 1610, without departing from the scope hereof. In an alternate embodiment, first leakage post 1612 is connected to outer plate 1610, instead of winding form element 1608. Although the various components of magnetic core 1602 are delineated in the figures to help a viewer distinguish these elements, lines separating elements of magnetic core 1602 do not necessarily represent discontinuities in magnetic core 1602. For example, first and second end flanges 1604 and 1606 and winding form element 1608 could be part of a single monolithic magnetic structure.

Low profile coupled inductor 1600 further includes a first winding 1624 and a second winding 1626 each wound around center axis 1628. First winding 1624 is wound around winding form element 1608, such that first winding 1624 is disposed between first end flange 1604 and first leakage post 1612 in first direction 1614. Similarly, second winding 1626 is wound around winding form element 1608, such that second winding 1626 is disposed between first leakage post 1612 and second end flange 1606 in first direction 1614.

Figure 18:
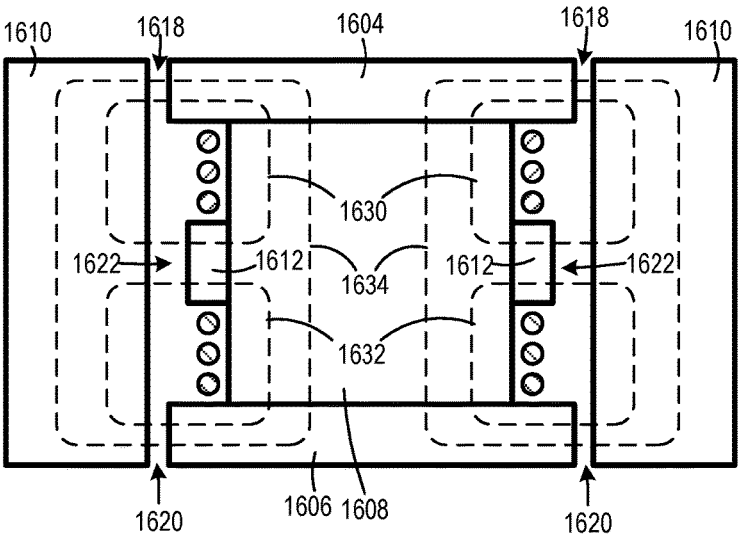
FIG. 18 is a cross-sectional view of the FIG. 16 low-profile coupled inductor illustrating approximate magnetic flux paths.

FIG. 18 is a cross-sectional view like that of FIG. 17, but further illustrating approximate magnetic flux paths in low-profile coupled inductor 1600. Leakage magnetic flux 1630 associated with first winding 1624, as well as leakage magnetic flux 1632 associated with second winding 1626, both flow through first leakage post 1612 and first leakage gap 1622. Magnetizing flux 1634, on the other hand, does not flow through either first leakage post 1612 or first leakage gap 1622. Consequentially, leakage inductance values of low-profile coupled inductor 1600 can advantageously be adjusted during design and/or manufacture, independent of magnetizing inductance, simply by adjusting the configuration of first leakage post 1612 and/or first leakage gap 1622. For example, leakage inductance could be decreased by increasing the thickness of first leakage gap 1622 in second direction 1616. Magnetizing inductance can be adjusted by adjusting the configuration of first magnetizing gap 1618 and/or second magnetizing gap 1620. For example, magnetizing inductance could be decreased by increasing the thickness of first magnetizing gap 1618 and/or second magnetizing gap 1620 in second direction 1616.

Low-profile coupled inductor 1600 may achieve advantages similar to those discussed above with respect to low-profile coupled inductor 100. For example, leakage inductance values can be adjusted independently of magnetizing inductance values, as discussed above. Additionally, the fact that both first winding 1624 and second winding 1626 are wound around common center axis 1628 potentially enables both windings to be simultaneously wound, thereby promoting manufacturing efficiency and simplicity. Furthermore, first end flange 1604, first leakage post 1612, and second end flange 1606 help confine first winding 1624 and second winding 1626 to their respective positions on winding form element 1608, thereby reducing, or even eliminating, the need for additional features to control winding position. Moreover, the fact that first and second windings 1624 and 1626 are wound around a portion of magnetic core 1602, instead of embedded in the magnetic core, allows greater flexibility in choosing magnetic material forming magnetic core 1602. Additionally, the configuration of magnetic core 1602 advantageously allows 360-degree access to winding form element 1608 before outer plate 1610 is installed, thereby potentially enabling first and second windings 1624 and 1626 to be wound directly on magnetic core 1602, such as by rotating magnetic core 1602 around center axis 1628.

Figure 19:
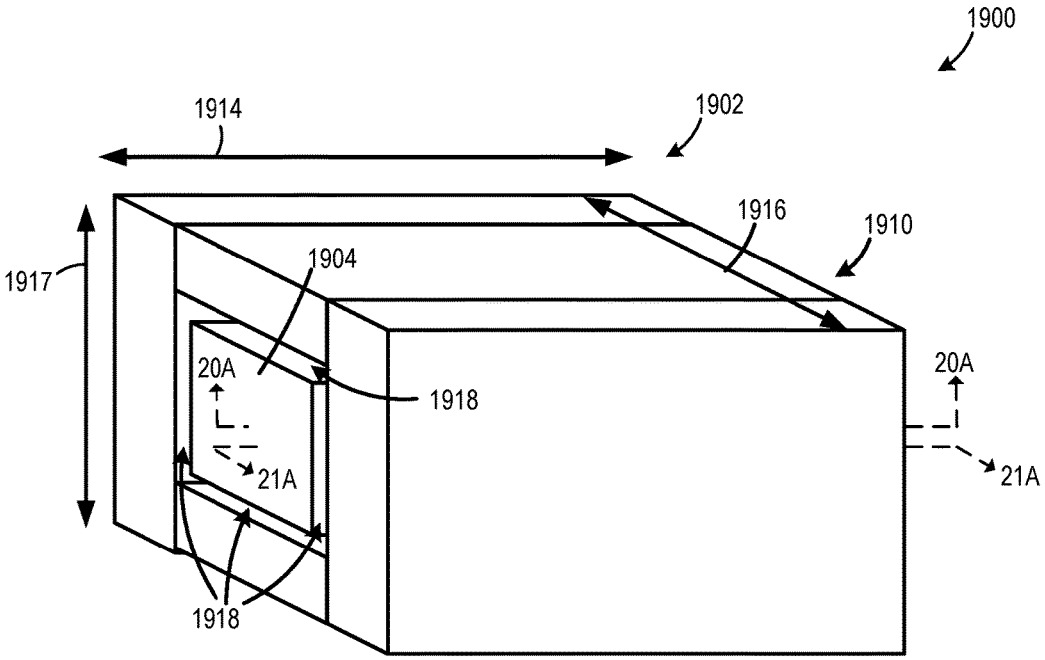
FIG. 19 is a perspective view of a low-profile coupled inductor, which is similar to the low-profile coupled inductor of FIG. 16, but has a rectangular shape instead of a round shape, according to an embodiment.
Figure 20:
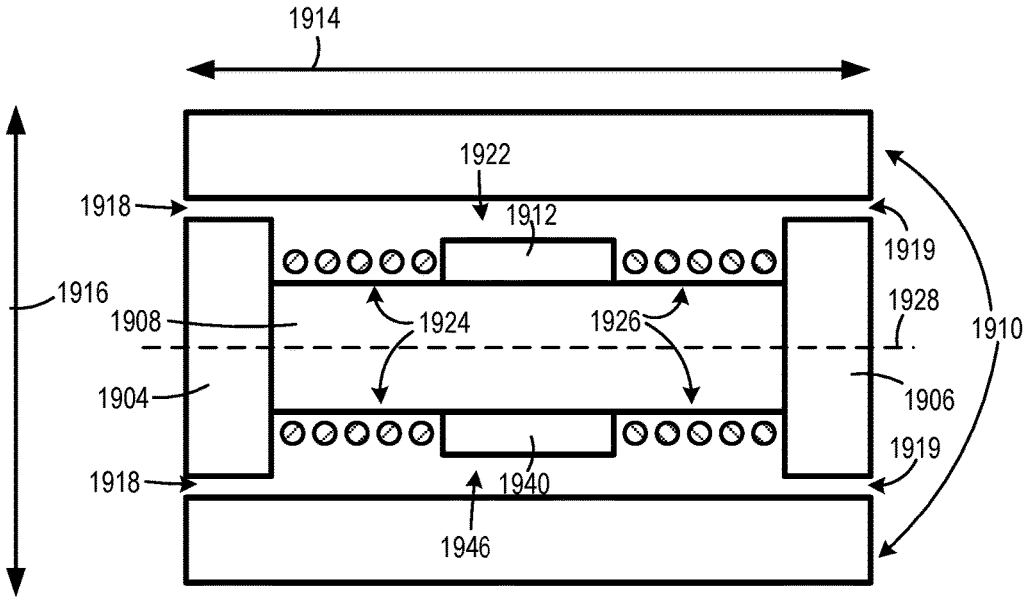
FIG. 20 is a cross-sectional view of the low-profile coupled inductor of FIG. 19 taken along line 20A-20A of FIG. 19.
Figure 21:
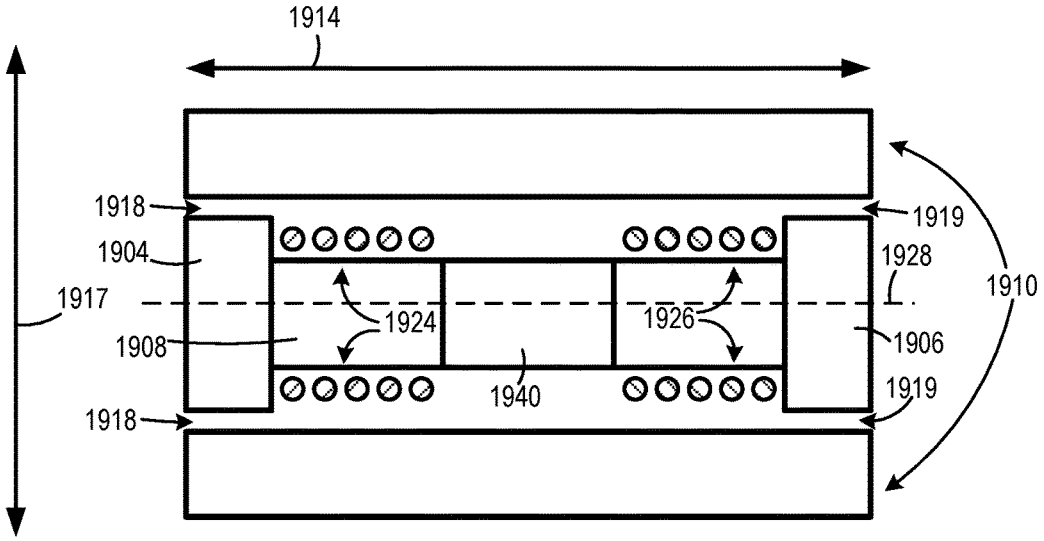
FIG. 21 is a cross-sectional view of the low-profile coupled inductor of FIG. 19 taken along line 21A-21A of FIG. 19.

FIG. 19 is a perspective view of a low-profile coupled inductor 1900, which is similar to coupled inductor 1600 of FIG. 16, but has a rectangular shape instead of a round shape. FIG. 20 is a cross-sectional view of low-profile coupled inductor 1900 taken along line 20A-20A of FIG. 19, and FIG. 21 is a cross-sectional view of low-profile coupled inductor 1900 taken along line 21A-21A of FIG. 19. Low profile coupled inductor 1900 includes a magnetic core 1902 including a first end flange 1904, a second end flange 1906, a winding forming element 1908, a tubular outer plate 1910, a first leakage post 1912, and a second leakage post 1940. First end flange 1904 and second end flange 1906 are separated from each other in a first direction 1914, and winding form element 1908 is disposed between and connects first end flange 1904 and second end flange 1906 in first direction 1914. Each of first end flange 1904, second end flange 1906, and winding form element 1908 has a rectangular shape, as seen when coupled inductor 1900 is viewed cross-sectionally in first direction 1914. Outer plate 1910 surrounds each of first end flange 1904, second end flange 1906, and winding form element 1908, when low-profile coupled inductor 1900 is viewed cross-sectionally in first direction 1914. First leakage post 1912 and second leakage post 1940 are each disposed on opposite sides of winding form element 1908, such that each leakage post 1912 and 1940 is disposed between winding form element 1908 and outer plate 1910, in a second direction 1916 orthogonal to first direction 1914.

First end flange 1904 is separated from outer plate 1910 in second direction 1916 and in a third direction 1917 by a first magnetizing gap 1918, and second end flange 1906 is separated from outer plate 1910 by a second magnetizing gap 1919 in second direction 1916 and in third direction 1917. Third direction 1917 is orthogonal to both first direction 1914 and second direction 1916. First leakage post 1912 is separated from outer plate 1910 by a first leakage gap 1922 in second direction 1916, and second leakage post 1940 is separated from outer plate 1910 by a second leakage gap 1946 in second direction 1916. (See FIG. 20). In some alternate embodiments, such as embodiments where magnetic core 1902 is formed of magnetic material having a distributed gap, one or more of first magnetizing gap 1918, second magnetizing gap 1919, first leakage gap 1922, and second leakage gap 1946 are omitted. One or more of first leakage post 1912 and second leakage post 1940 could be replaced with two or more leakage posts without departing from the scope hereof.

Low-profile coupled inductor 1900 further includes a first winding 1924 and a second winding 1926 similar to first winding 1624 and second winding 1626 of low-profile coupled inductor 1600, respectively. Specifically, each of first winding 1924 and second winding 1926 is wound around a common axis 1928 extending in first direction 1914. First winding 1924 is wound around winding form element 1908, such that first winding 1924 is disposed between first end flange 1904 and first and second leakage posts 1912 and 1940 in first direction 1914. Similarly, second winding 1926 is wound around winding form element 1908, such that second winding 1926 is disposed between first and second leakage posts 1912 and 1940 and second end flange 1906, in first direction 1914.

Figure 22:
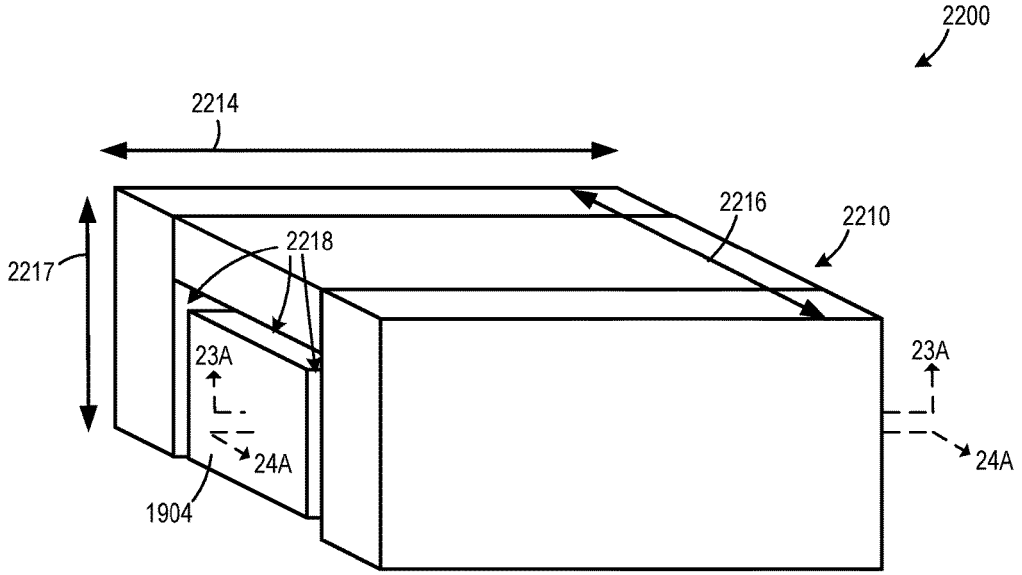
FIG. 22 is a perspective view of a low-profile coupled inductor similar to that of FIG. 19, but where the outer plate forms a rectangular C-shape, according to an embodiment.
Figure 23:
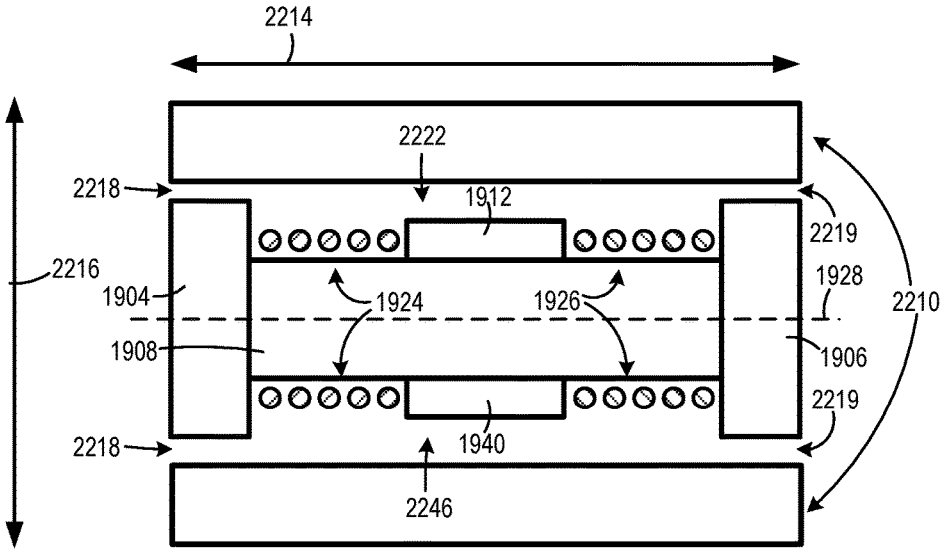
FIG. 23 is a cross-sectional view of the low-profile coupled inductor of FIG. 22 taken along line 23A-23A of FIG. 22.
Figure 24:
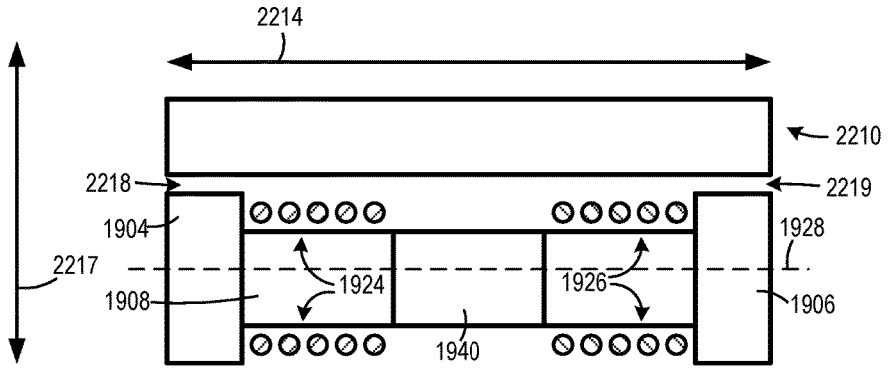
FIG. 24 is a cross-sectional view of the low-profile coupled inductor of FIG. 22 taken along line 24A-24A of FIG. 22.

FIG. 22 is a perspective view of a low-profile coupled inductor 2200, which is similar to low-profile coupled inductor 1900 of FIG. 19, but with outer plate 1910 replaced with an outer plate 2210 which only partially surrounds first end flange 1904, second end flange 1906, and winding form element 1908. Specifically, outer plate 2210 forms a rectangular C-shape, as seen when coupled inductor 2200 is view cross-sectionally in first direction 2214. As a result, one side of coupled inductor 2200 is open, such as to allow for electrical connections with a printed circuit board or other electronic circuitry. FIG. 23 is a cross-sectional view of low-profile coupled inductor 2200 taken along line 23A-23A of FIG. 22, and FIG. 24 is a cross-sectional view of low-profile coupled inductor 2200 taken along line 24A-24A of FIG. 22.

First end flange 1904 is separated from outer plate 2010 in second direction 2216 and in a third direction 2217 by a first magnetizing gap 2218, and second end flange 1906 is separated from outer plate 2210 by a second magnetizing gap 2219 in second direction 2216 and in third direction 2217. Third direction 2217 is orthogonal to both first direction 2214 and second direction 2216. First leakage post 1912 is separated from outer plate 2210 by a first leakage gap 2222 in second direction 2216, and second leakage post 1940 is separated from outer plate 2210 by a second leakage gap 2246 in second direction 2216. (See FIG. 23). In some alternate embodiments, one or more of first magnetizing gap 2218, second magnetizing gap 2219, first leakage gap 2222, and second leakage gap 2246 are omitted. One or more of first leakage post 1912 and second leakage post 1940 could be replaced with two or more leakage posts without departing from the scope hereof.

Figure 25:
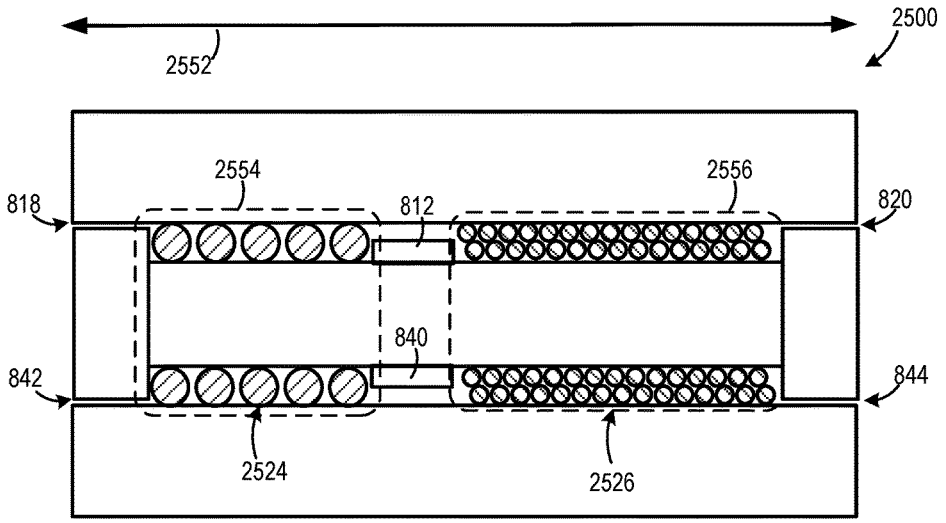
FIG. 25 is a cross-sectional view of a low-profile coupled inductor similar to that of FIG. 8, but having asymmetrical windings and winding windows, according to an embodiment.

The exemplary low-profile coupled inductors illustrated in FIG. 1-24 are symmetrical. However, any of the coupled inductors disclosed herein could be modified to be asymmetrical, such as to achieve asymmetrical leakage inductance values or to enable use of two different winding configurations. For example, FIG. 25 is a cross-sectional view of a low-profile coupled inductor 2500, which is similar to low-profile coupled inductor 800 of FIG. 8, but having asymmetrical windings and winding windows. Specifically, first winding 824 is replaced with first winding 2524 formed of low-gauge wire and forming five turns, while second winding 826 is replaced with second winding 2526 formed of relatively high-gauge wire and forming many turns. Additionally, first leakage post 812 and second leakage post 840 are disposed off-center along a width 2552 of coupled inductor 2500, so that a first winding window 2554 for first winding 2524 is smaller than a second winding window 2556 for second winding 2526. This asymmetric nature of coupled inductor 2500 may be desirable, for example, in applications where first winding 2524 must support large current values and small leakage inductance is desired, and where second winding 2526 need only support small current value and large leakage inductance is desired. The other low-profile coupled inductors disclosed herein could be modified to be asymmetrical in a similar manner to that of FIG. 25.

With the exception of second winding 2526 in low-profile coupled inductor 2500 of FIG. 25, the windings in the low-profile coupled inductors of FIG. 1-25 form a single row of turns along their respective winding form elements. This configuration advantageously minimizes winding thickness in a direction orthogonal to the common axis and also promotes strong magnetic coupling of windings. However, it may be desirable in some applications for the windings to form two or more rows of turns, to minimize winding thickness in a direction parallel to the center axis.

Figure 26:
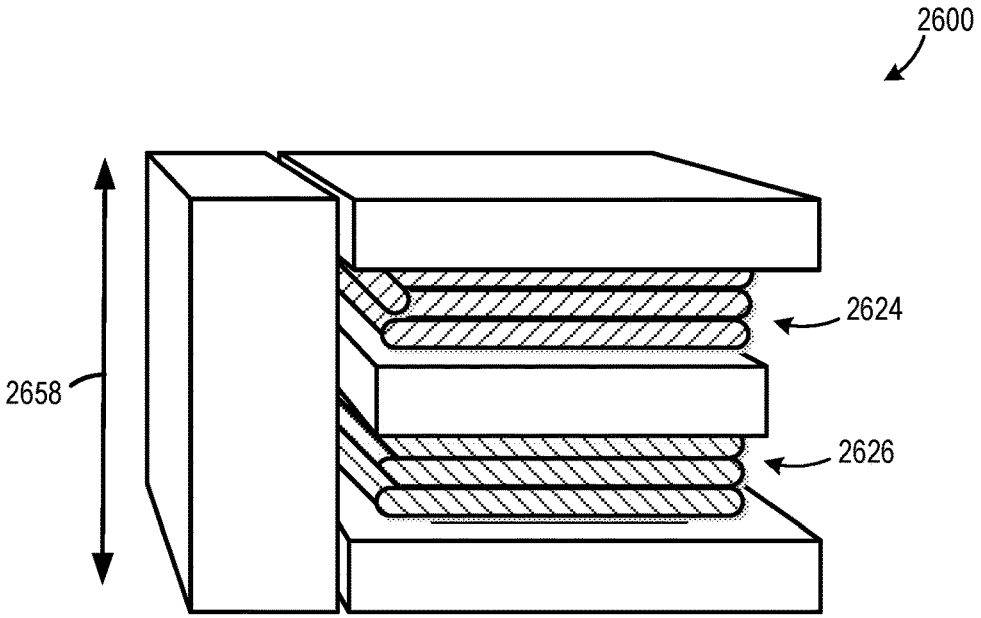
FIG. 26 is a perspective view of a low-profile coupled inductor similar to that of FIG. 5, but having been rotated by 90 degrees, according to an embodiment.

For example, FIG. 26 is a perspective view of a low-profile coupled inductor 2600, which is similar to low-profile coupled inductor 500 of FIG. 5, but has been rotated by 90 degrees. Low profile coupled inductor 2600 includes a first winding 2624 and a second winding 2626 in place of first winding 124 and second winding 126, respectively. Each of first winding 2624 and second winding 2626 forms multiple turns in a plane orthogonal to a profile 2658 of the coupled inductor, to help minimize profile 2658.

Figure 27:
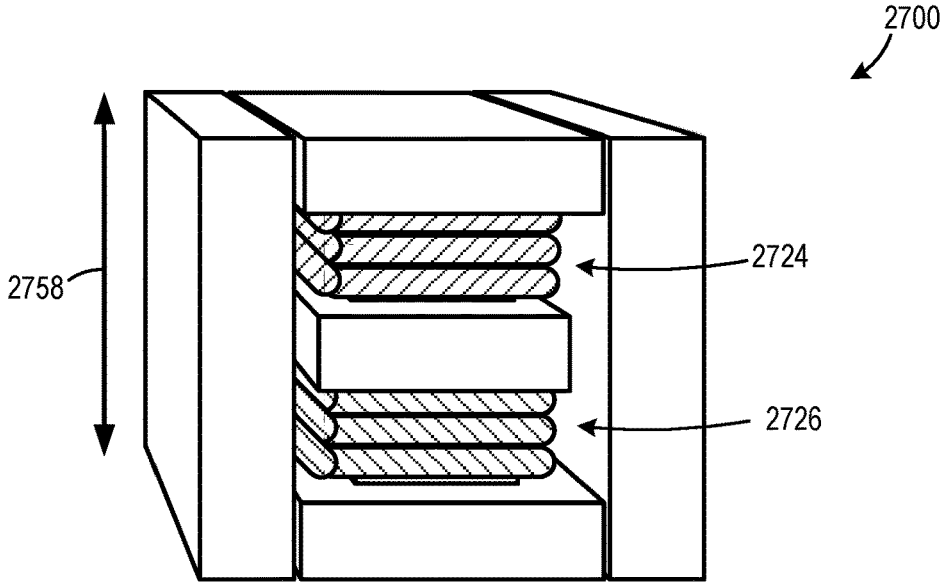
FIG. 27 is a perspective view of a low-profile coupled inductor similar to that of FIG. 8, but having been rotated by 90 degrees, according to an embodiment.

Similarly, FIG. 27 is a perspective view of a low-profile coupled inductor 2700, which is similar to low-profile coupled inductor 800 of FIG. 8, but has been rotated by 90 degrees. Low profile coupled inductor 2700 includes a first winding 2724 and a second winding 2726 in place of first winding 824 and second winding 826, respectively. Each of first winding 2724 and second winding 2726 forms multiple turns in a plane orthogonal to a profile 2758 of the coupled inductor, to help minimize profile 2758.

The low-profile coupled inductors disclosed herein optionally further include electrical contacts (not shown), such as solder tabs or through-hole pins, for interfacing the windings with external circuitry. The contacts are applied, for example, using known techniques for disposing electrical contacts on magnetic elements. In certain embodiments, these electrical contacts are disposed on the winding form element so that only the winding form element need be coupled to a supporting substrate, such as a printed circuit board. This configuration advantageously isolates the end flanges and outer plate(s) from the supporting substrate and its associated thermal and mechanical strain, thereby promoting stable magnetizing and leakage gap thickness.

Figure 28:
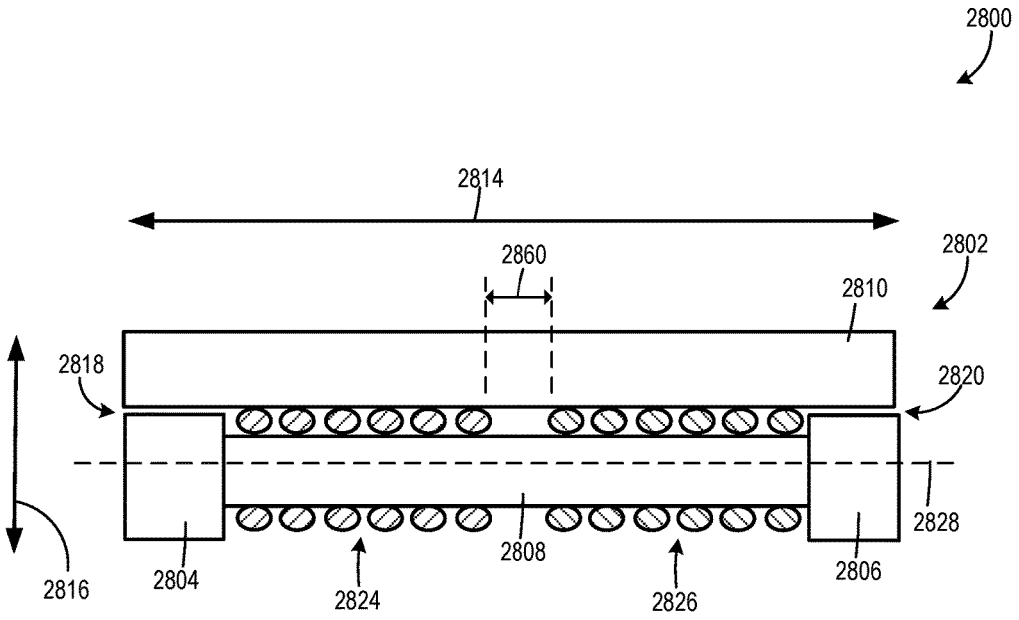
FIG. 28 is a cross-sectional view of a low-profile coupled inductor including a magnetic core without a leakage post, according to an embodiment.
Figure 29:
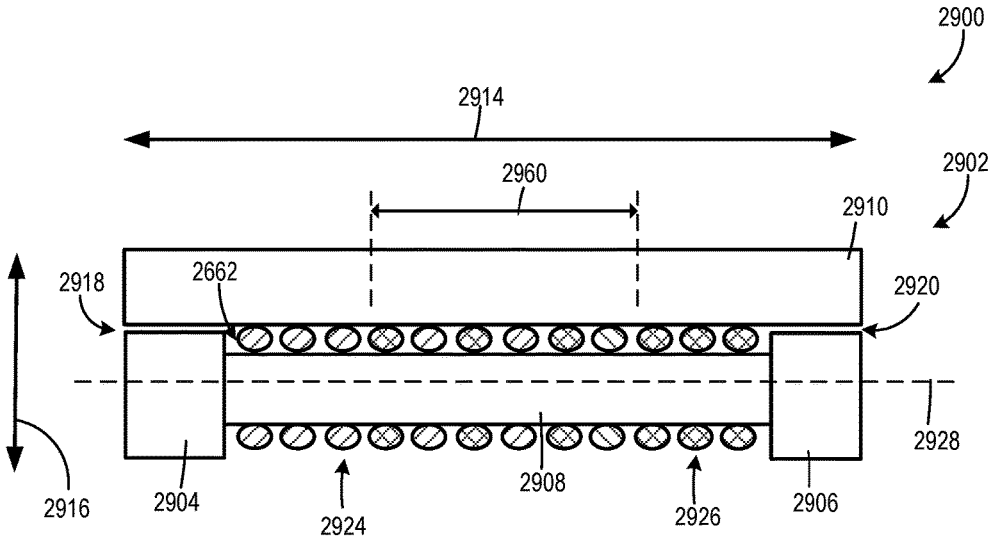
FIG. 29 is a low-profile coupled inductor including partially interleaved windings, according to an embodiment.

While the low-profile coupled inductors discussed above include at least one leakage post, each of these coupled inductors could be modified to omit its respective one or more leakage posts. For example, FIG. 28 is a cross-sectional view of a low-profile coupled inductor 2800, which is similar to low-profile coupled inductor 100 of FIG. 1, but does not include a leakage post. In particular, low-profile coupled inductor 2800 includes a magnetic core 2802 including a first end flange 2804, a second end flange 2806, a winding form element 2808, and a first outer plate 2810. First end flange 2804 and second end flange 2806 are separated from each other in a first direction 2814, and winding form element 2808 is disposed between and connects first and second end flanges 2804 and 2806 in first direction 2814. First outer plate 2810 is disposed over and faces first and second end flanges 2804 and 2806 in a second direction 2816, orthogonal to first direction 2814. First end flange 2804 is separated from first outer plate 2810 in second direction 2816 by a first magnetizing gap 2818, and second end flange 2806 is separated from first outer plate 2810 by a second magnetizing gap 2820 in second direction 2816.

Low-profile coupled inductor 2800 further includes a first winding 2824 and a second winding 2826 each wound around a common axis 2828 extending in first direction 2814. First winding 2824 is separated from second winding 2826 in first direction 2814 by a separation distance 2860. Leakage inductance values of first winding 2824 and second winding 2826 are adjusted during the design or manufacture of coupled inductor 2800, for example, by adjusting separation distance 2860. For example, if greater leakage inductance is desired, separation distance 2860 can be increased. Alternately or additionally, leakage inductance can be adjusted during coupled inductor design or manufacture by adjusting the configuration, such as cross-sectional area, of first end flange 2804 and/or second end flange 2806. Although low-profile coupled inductor 2800 is illustrated as being symmetrical, it would be modified to be asymmetrical without departing from the scope hereof.

The low-profile coupled inductors disclosed above are advantageously capable of achieving controlled leakage inductance values which are relatively large, such as for use in multi-phase converter applications where the coupling factor between the phases is higher than required, where the coupling factor is the ratio of magnetizing inductance to leakage inductance. In some applications, there may be a need for leakage inductance values to be relatively small, such as in low-profile coupled inductors having an extreme aspect ratio or a magnetic core formed of a low permeability magnetic material, to achieve a sufficiently large coupling factor.

Therefore, Applicant has additionally developed low-profile coupled inductors with interleaved windings which are capable of achieving relatively large controlled coupling factors. For example, FIG. 2900 is a cross-sectional view of a low-profile coupled inductor 2900, which is similar to low-profile coupled inductor 2800 of FIG. 28, but with selective interleaving of windings.

Low-profile coupled inductor 2900 includes a magnetic core 2902 including a first end flange 2904, a second end flange 2906, a winding form element 2908, and a first outer plate 2910. First end flange 2904 and second end flange 2906 are separated from each other in a first direction 2914, and winding form element 2908 is disposed between and connects first and second end flanges 2904 and 2906 in first direction 2914. First outer plate 2910 is disposed over and faces first and second end flanges 2904 and 2906 in a second direction 2916, orthogonal to first direction 2914. First end flange 2904 is separated from first outer plate 2910 in second direction 2916 by a first magnetizing gap 2918, and second end flange 2906 is separated from first outer plate 2910 by a second magnetizing gap 2920 in second direction 2916.

Low profile coupled inductor includes a first winding 2924 and a second 2926 wound around winding form element 2908 and a common axis 2928 extending in first direction 2914. First winding 2924 and second winding 2926 are interleaved within an interleaved portion 2960 of winding window 2962, but the windings are not interleaved outside of interleaved portion 2960. Magnetic flux will leak from winding form element 2908 to first outer plate 2910 between windings outside of interleaved portion 2960. Within interleaved portion 2960, in contrast, the magnetic flux will couple from one winding to the other, resulting in magnetizing inductance.

Coupling factor can advantageously be controlled by varying the portion of first and second windings 2924 and 2926 that are interleaved, or in other words, by varying the portion of winding window 2962 occupied by interleaved portion 2960. For example, coupling factor can be increased during the design or manufacture of low-profile coupled inductor 2900 by increasing the portion of first and second windings 2924 and 2926 which are interleaved, or in other words, by increasing the size of interleaved portion 2960. Maximum coupling factor can be achieved by fully interleaving first and second windings 2924 and 2926.

Accordingly, coupled inductor parameters can be controlled in low-profile coupled inductor 2900 in a way that can increase the coupling factor for cases where the initial coupling factor is lower than desired. Additionally, the other low-profile coupled inductors disclosed herein could be modified so that their respective windings are interleaved in a similar manner. By the appropriate application of interleaving and/or leakage control posts, it is possible to independently control magnetizing and leakage inductances in a variety of structures where the magnetic properties prior to application of these methods may have exhibited either higher or lower than optimal coupling.

Figure 30:
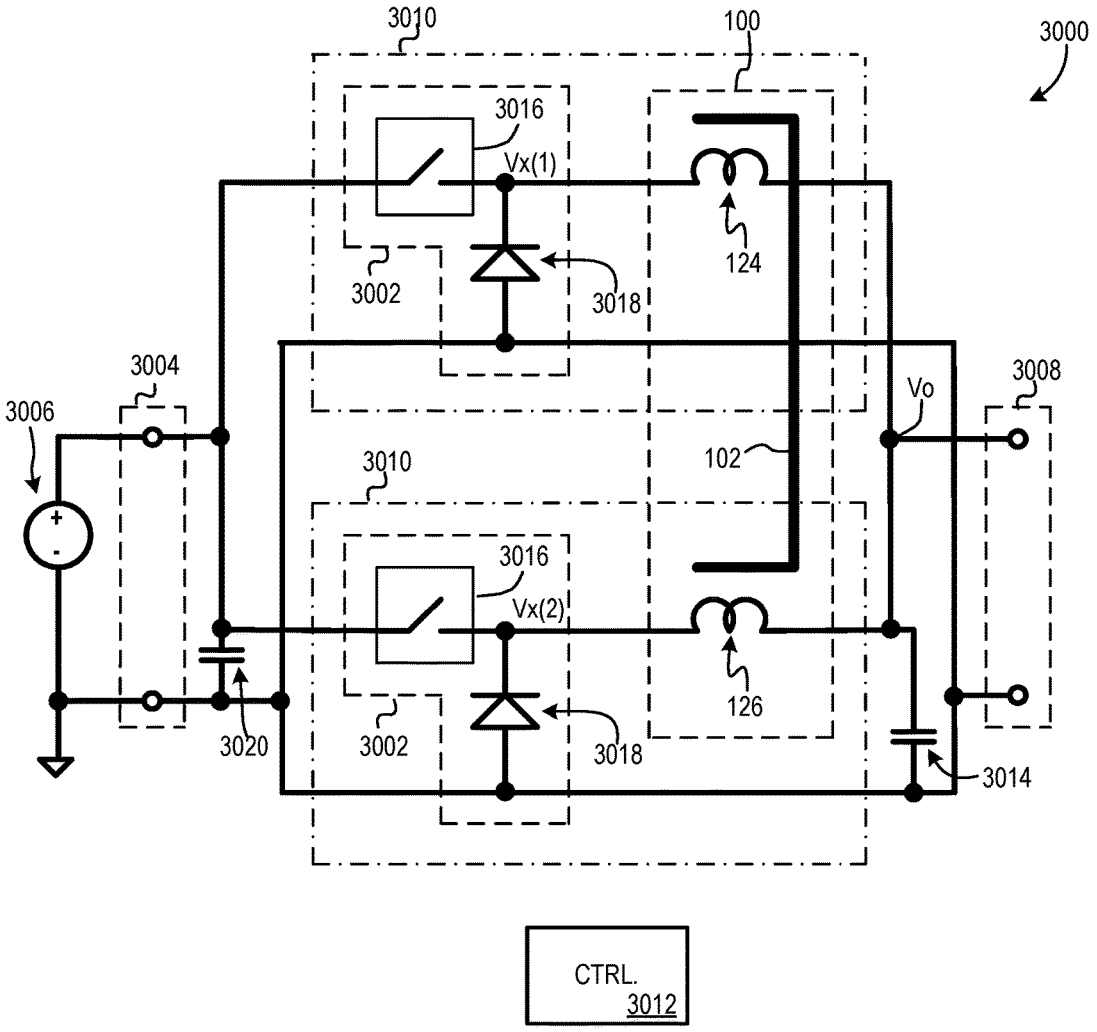
FIG. 30 illustrates a multi-phase buck converter including the low-profile coupled inductor of FIG. 1, according to an embodiment.

One possible application of the low-profile coupled inductors disclosed herein is in multi-phase switching power converter applications, including but not limited to, multi-phase buck converter applications, multi-phase boost converter applications, or multi-phase buck-boost converter applications. For example, FIG. 30 illustrates one possible use of low-profile coupled inductor 100 (FIG. 1) in a multi-phase buck converter 3000. Each of first winding 124 and second winding 126 is electrically coupled between a respective switching node $V_x$ and a common output node $V_o$. A respective switching circuit 3002 is electrically coupled to each switching node $V_x$. Each switching circuit 3002 is electrically coupled to an input port 3004, which is in turn electrically coupled to an electric power source 3006. An output port 3008 is electrically coupled to output node $V_o$. Each switching circuit 3002 and respective inductor is collectively referred to as a "phase" 3010 of the converter. Thus, multi-phase buck converter 3000 is a two-phase converter.

A controller 3012 causes each switching circuit 3002 to repeatedly switch its respective winding end between electric power source 3006 and ground, thereby switching its winding end between two different voltage levels, to transfer power from electric power source 3006 to a load (not shown) electrically coupled across output port 3008. Controller 3012 typically causes switching circuits 3002 to switch at a relatively high frequency, such as at one hundred kilohertz or greater, to promote low ripple current magnitude and fast transient response, as well as to ensure that switching induced noise is at a frequency above that perceivable by humans. Additionally, in certain embodiments, controller 3012 causes switching circuits 3002 to switch out-of-phase with respect to each other in the time domain to improve transient response and promote ripple current cancellation in output capacitors 3014.

Each switching circuit 3002 includes a control switching device 3016 that alternately switches between its conductive and non-conductive states under the command of controller 3012. Each switching circuit 3002 further includes a freewheeling device 3018 adapted to provide a path for current through its respective winding 124 or 126 when the control switching device 3016 of the switching circuit transitions from its conductive to non-conductive state. Freewheeling devices 3018 may be diodes, as shown, to promote system simplicity. However, in certain alternate embodiments, freewheeling devices 3018 may be supplemented by or replaced with a switching device operating under the command of controller 3012 to improve converter performance. For example, diodes in freewheeling devices 3018 may be supplemented by switching devices to reduce freewheeling device 3018 forward voltage drop. In the context of this disclosure, a switching device includes, but is not limited to, a bipolar junction transistor, a field effect transistor (e.g., a N-channel or P-channel metal oxide semiconductor field effect transistor, a junction field effect transistor, a metal semiconductor field effect transistor), an insulated gate bipolar junction transistor, a thyristor, or a silicon controlled rectifier.

Controller 3012 is optionally configured to control switching circuits 3002 to regulate one or more parameters of multi-phase buck converter 3000, such as input voltage, input current, input power, output voltage, output current, or output power. Buck converter 3000 typically includes one or more input capacitors 3020 electrically coupled across input port 3004 for providing a ripple component of switching circuit 3002 input current. Additionally, one or more output capacitors 3014 are generally electrically coupled across output port 3008 to shunt ripple current generated by switching circuits 3002.

Buck converter 3000 could be modified to use one of the other low-profile coupled inductors disclosed herein, such as low-profile coupled inductor 500, 800, 1200, 1300, 1400, 1500, 1600, 1900, 2200, 2500, 2600, 2700, 2800, or 2900. Additionally, buck converter 3000 could also be modified to have a different multi-phase switching power converter topology, such as that of a multi-phase boost converter or a multi-phase buck-boost converter, or an isolated topology, such as a flyback or forward converter without departing from the scope hereof.

Moreover, the low-profile coupled inductors disclosed herein could be used in heterogeneous converter applications, such as to achieve magnetic coupling of multiple single-phase converters having different topologies. For example, asymmetrical low-profile coupled inductor 2500 (FIG. 25) could be shared by a boost converter and an inverter, where first winding 2524 forms part of the boost converter, and second winding 2526 forms parts of the inverter. The asymmetrical nature of low-profile coupled inductor 2500 allows the properties of each inductor therein, such as leakage inductance and current carrying capability of each inductor, to be tailored for its respective converter.

Combinations of Features

Features described above may be combined in various ways without departing from the scope hereof. The following examples illustrate some possible combinations:

(A1) A low-profile coupled inductor may include a magnetic core, a first winding, and a second winding. The magnetic core may include (1) first and second end flanges, (2) a winding form element disposed between and connecting the first and second end flanges in a first direction, (c) a first outer plate disposed over and facing the first and second end flanges in a second direction, the second direction orthogonal to the first direction, and (d) a first leakage post disposed between the winding form element and the first outer plate in the second direction. The first winding may be wound around the winding form element, between the first end flange and the first leakage post, and the second winding may be wound around the winding form element, between the first leakage post and the second end flange. Each of the first and second windings may be wound around a common axis extending in the first direction.

(A2) In the low-profile coupled inductor denoted as (A1), the first leakage post may be separated, in the second direction, from one of the winding form element and the first outer plate by a first leakage gap.

(A3) In the low-profile coupled inductor denoted as (A2), the first leakage post may be attached to the winding form element and may be separated from the first outer plate by the first leakage gap.

(A4) In the low-profile inductor denoted as (A3), the first outer plate may form a first recess extending into the first outer plate in the second direction, and the first leakage post may face the first recess in the second direction.

(A5) In the low-profile coupled inductor denoted as (A2), the first leakage post may be attached to the first outer plate and separated from the winding form element by the first leakage gap.

(A6) In any of the low-profile coupled inductors denoted as (A1) through (A5), the first outer plate may be separated from the first end flange by a first magnetizing gap in the second direction, and the first outer plate may be separated from the second end flange by a second magnetizing gap in the second direction.

(A7) In any of the low profile inductors denoted as (A1) through (A6), the winding form element and the first and second end flanges may be formed of a ferrite magnetic material, and the first outer plate may be formed of a magnetic paste.

(A8) In any of the low-profile coupled inductors denoted as (A1) through (A7), each of the first and second windings may form multiple turns around the winding form element.

(A9) In any of the low-profile coupled inductors denoted as (A1) through (A8), the magnetic core may further include (1) a second outer plate disposed over and facing the first and second end flanges in the second direction, such that the first and second end flanges and the winding form element are each disposed between first and second outer plates in the second direction, and (2) a second leakage post disposed between the winding form element and the second outer plate in the second direction.

(A10) In the low profile inductor denoted as (A9), the second leakage post may be separated from one of the winding form element and the second outer plate by a second leakage gap in the second direction.

(A11) In the low-profile coupled inductor denoted as (A10), the second leakage post may be attached to the winding form element and may be separated from the second outer plate by the second leakage gap.

(A12) In either of the low profile inductors denoted as (A10) or (A11), the second outer plate may form a second recess extending into the second outer plate in the second direction, and the second leakage post may face the second recess in the second direction.

(A13) In the low-profile coupled inductor denoted as (A10), the second leakage post may be attached to the second outer plate and separated from the winding form element by the second leakage gap.

(A14) In any of the low-profile coupled inductors denoted as (A9) through (A13), the second outer plate may be separated from the first end flange by a third magnetizing gap in the second direction, and the second outer plate may be separated from the second end flange by a fourth magnetizing gap in the second direction.

(B1) A low-profile coupled inductor may include a magnetic core, a first winding, and a second winding. The magnetic core may include (1) first and second end flanges, (2) a winding form element disposed between and connecting the first and second end flanges in a first direction, (c) an outer plate at least partially surrounding each of the first and second end flanges and the winding form element, as seen when the low-profile coupled inductor is viewed cross-sectionally in the first direction, and (d) a first leakage post disposed between the winding form element and the outer plate. The first winding may be wound around the winding form element, between the first end flange and the first leakage post, and the second winding may be wound around the winding form element, between the leakage post and the second end flange. Each of the first and second windings may be wound around a common axis extending in the first direction.

(B2) In the low-profile coupled inductor denoted as (B1), each of the first and second end flanges may have a circular shape, as seen when the low-profile coupled inductor is viewed cross-sectionally in the first direction, and the outer plate may have a ring shape, as seen when the low-profile coupled inductor is viewed cross-sectionally in the first direction.

(B3) In the low-profile coupled inductor denoted as (B1), each of the first and second end flanges may have a rectangular shape, as seen when the low-profile coupled inductor is viewed cross-sectionally in the first direction, and the outer plate may have a rectangular shape, as seen when the low-profile coupled inductor is viewed cross-sectionally in the first direction.

(B4) In the low-profile coupled inductor denoted as (B3), the outer plate may have a C-shape, as seen when the low-profile coupled inductor is viewed cross-sectionally in the first direction.

(B5) In the low-profile inductor denoted as (B4), each of the first and second end flanges may have a rectangular shape, as seen when the low profile coupled inductor is viewed cross-sectionally in the first direction, and the outer plate may have a rectangular C-shape, as seen when the low-profile coupled inductor is viewed cross-sectionally in the first direction.

(C1) A low-profile coupled inductor may include a magnetic core, a first winding, and a second winding. The magnetic core may include (1) first and second end flanges, (2) a winding form element disposed between and connecting the first and second end flanges in a first direction, and (c) a first outer plate disposed over and facing the first and second end flanges in a second direction, the second direction orthogonal to the first direction. The first and second windings may each be wound around the winding form element, such that the first winding is separated from the second winding in the first direction by a separation distance. Each of the first and second windings may be wound around a common axis extending in the first direction.

(C2) In the low-profile coupled inductor denoted as (C1), the first outer plate may be separated from the first end flange by a first magnetizing gap in the second direction, and the first outer plate may be separated from the second end flange by a second magnetizing gap in the second direction.

(C3) In either of the low profile inductors denoted as (C1) or (C2), the winding form element and the first and second end flanges may be formed of a ferrite magnetic material, and the first outer plate may be formed of a magnetic paste.

(C4) In any of the low-profile coupled inductors denoted as (C1) through (C3), each of the first and second windings may form multiple turns around the winding form element.

(C5) In any of the low-profile coupled inductors denoted as (C1) through (C4), the magnetic core may further include a second outer plate disposed over and facing the first and second end flanges in the second direction, such that the first and second end flanges and the winding form element are each disposed between first and second outer plates in the second direction.

(C6) In any of the low-profile coupled inductors denoted as (C1) through (C5), at least a portion of the first and second windings may be interleaved.

(D1) A multi-phase switching power converter may include any one of the low-profile coupled inductors denoted as (A1) through (A14), (B1) through (B5), and or (C1) through (C6).

(D2) In the multi-phase switching power converter denoted as (D1), each winding may be electrically coupled between a respective switching node and a common output node.

(D3) The multi-phase switching power converter denoted as (D2) may further include a respective switching circuit electrically coupled to each switching node.

(D4) The multi-phase switching power converter denoted as (D3) may further include a controller for causing each switching circuit to repeatedly switch its respective winding end between two different voltage levels, to transfer power from an electric power source to a load.

(D5) Any of the multi-phase switching power converters denoted as (D1) through (D4) may be a multi-phase buck converter.

Changes may be made in the above low-profile coupled inductors and associated methods without departing from the scope hereof. It should thus be noted that the matter contained in the above description and shown in the accompanying drawings should be interpreted as illustrative and not in a limiting sense.

What is claimed is:

1. A low-profile coupled inductor, comprising:

a magnetic core, including:

first and second end flanges, a winding form element disposed between and connecting the first and second end flanges in a first direction, a first outer plate disposed over and facing the first and second end flanges in a second direction, the second direction orthogonal to the first direction, the first outer plate forming a first recess extending into the first outer plate in the second direction, and a first leakage post disposed between the winding form element and the first outer plate in the second direction, the first leakage post facing the first recess in the second direction;

a first winding wound around the winding form element, between the first end flange and the first leakage post; and a second winding wound around the winding form element, between the first leakage post and the second end flange, each of the first and second windings wound around a common axis extending in the first direction;

the magnetic core further including:

a second outer plate disposed over and facing the first and second end flanges in the second direction, such that the first and second end flanges and the winding form element are each disposed between first and second outer plates in the second direction; and a second leakage post disposed between the winding form element and the second outer plate in the second direction;

the second leakage post being attached to the winding form element and being separated from the second outer plate by a second leakage gap in the second direction;

the second outer plate forming a second recess extending into the second outer plate in the second direction, the second leakage post facing the second recess in the second direction.

2. The low-profile coupled inductor of claim 1, each of the first and second windings forming multiple turns around the winding form element.

3. The low-profile coupled inductor of claim 1, wherein:

the second outer plate is separated from the first end flange by a third magnetizing gap in the second direction; and the second outer plate is separated from the second end flange by a fourth magnetizing gap in the second direction.

4. The low-profile coupled inductor of claim 1, the first leakage post being attached to the winding form element and being separated, in the second direction, from the first outer plate by a first leakage gap.

5. The low-profile coupled inductor of claim 4, wherein:

the first outer plate is separated from the first end flange by a first magnetizing gap in the second direction; and the first outer plate is separated from the second end flange by a second magnetizing gap in the second direction.

6. The low profile inductor of claim 4, wherein:

the winding form element and the first and second end flanges are formed of a ferrite magnetic material; and the first outer plate is formed of a magnetic paste.

* * * * *